US009427974B2

(12) United States Patent
Fujimori et al.

(10) Patent No.: US 9,427,974 B2
(45) Date of Patent: Aug. 30, 2016

(54) LIQUID SUPPLY SYSTEM, LIQUID EJECTING APPARATUS, AND LIQUID SUPPLY METHOD

(71) Applicant: SEIKO EPSON CORPORATION, Tokyo (JP)

(72) Inventors: Ryoji Fujimori, Suwa (JP); Takeshi Iwamuro, Matsumoto (JP); Naoki Naito, Matsumoto (JP); Shunsuke Kuramata, Shiojiri (JP); Keiichiro Yoshino, Matsumoto (JP); Satoru Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/814,332

(22) Filed: Jul. 30, 2015

(65) Prior Publication Data

US 2016/0031225 A1 Feb. 4, 2016

(30) Foreign Application Priority Data

Aug. 1, 2014 (JP) ..... 2014-157603

(51) Int. Cl.
*B41J 2/175* (2006.01)

(52) U.S. Cl.
CPC ..... *B41J 2/17566* (2013.01)

(58) Field of Classification Search
CPC ..... B41J 2/17503; B41J 2/17506; B41J 2/17509; B41J 2/17543; B41J 2/17566
USPC ..... 347/5, 7, 14, 84–86
See application file for complete search history.

(56) References Cited

U.S. PATENT DOCUMENTS

2005/0062809 A1* 3/2005 Yoshino et al. ..... B41J 2/17556 347/85
2010/0214332 A1* 8/2010 Iwase ..... B41J 2/175 347/7

FOREIGN PATENT DOCUMENTS

| | | | |
|---|---|---|---|
| JP | 2006297660 A | * | 11/2006 |
| JP | 2007-083497 | | 4/2007 |
| JP | 2008-265009 | | 11/2008 |
| JP | 2009-202346 | | 9/2009 |
| JP | 2011-042127 | | 3/2011 |
| JP | 2013-144413 | | 7/2013 |

* cited by examiner

*Primary Examiner* — Julian Huffman
*Assistant Examiner* — Sharon A Polk
(74) *Attorney, Agent, or Firm* — Workman Nydegger

(57) ABSTRACT

A liquid supply system includes a common mounting portion into which a first liquid storage body capable of storing a liquid and a substitute mounting body which is connected to a second liquid storage body capable of storing a liquid can be exchangeably mounted, a mounting target detection unit capable of detecting whether or not the first liquid storage body and the substitute mounting body are mounted to the common mounting portion, a pressurization supply unit which supplies the liquid which is stored in the second liquid storage body to the substitute mounting body under pressure, and a control unit which drives the pressure supply unit when a plurality of control conditions are satisfied.

7 Claims, 13 Drawing Sheets

LIQUID SUPPLY SYSTEM, LIQUID EJECTING APPARATUS, AND LIQUID SUPPLY METHOD

BACKGROUND

1. Technical Field

The present invention relates to a liquid supply system, a liquid supply apparatus, a liquid ejecting apparatus, and a liquid supply method.

2. Related Art

An ink jet printer which performs printing by ejecting an ink from nozzles which are provided in a print head is an example of the liquid ejecting apparatus. Among such printers, there are printers in which the ink is supplied to the print head by driving a supply pump from a compact ink cartridge, and from an additional ink tank which has a greater ink storage capacity than the ink cartridge (for example, JP-A-2011-42127).

Incidentally, in a printer such as the one described above, there is a problem in that when the additional ink tank is configured to be attachable and detachable, depending on the mounting state of the additional ink tank, it may not be possible to supply the ink to the print head even if the supply pump is driven.

Note that, this problem is not limited to a printer which performs printing by ejecting an ink, and is generally common to cases in which a liquid storage body which stores a liquid for supplying is provided with a configuration which can be attached thereto and detached therefrom.

SUMMARY

An advantage of some aspects of the invention is to provide a liquid supply system, a liquid supply apparatus, a liquid ejecting apparatus, and a liquid supply method, each of which is capable of supplying a liquid, as appropriate, according to the mounting state of a liquid storage body.

Hereinafter, means of the invention and operation effects thereof will be described.

According to an aspect of the invention, there is provided a liquid supply system which includes a common mounting portion into which a first liquid storage body capable of storing a liquid and a substitute mounting body which is connected to a second liquid storage body capable of storing a liquid via a relay flow path can be exchangeably mounted, a mounting target detection unit capable of detecting whether or not the first liquid storage body and the substitute mounting body are mounted to the common mounting portion, a pressurization supply unit which supplies the liquid which is stored in the second liquid storage body to the substitute mounting body under pressure, and a control unit which drives the pressure supply unit when a plurality of control conditions are satisfied, in which the control conditions include the liquid which is stored in the second liquid storage body entering a pressurizable state and the mounting target detection unit detecting mounting of the substitute mounting body to the common mounting portion.

In this case, when the liquid which is stored in the second liquid storage body enters a pressurizable state and the mounting target detection unit detects the mounting of the substitute mounting body to the common mounting portion, since the pressurization supply unit is driven, it is possible to appropriately supply the liquid which is stored in the second liquid storage body through the relay flow path due to the pressurization supply unit being driven. Meanwhile, when the liquid which is stored in the second liquid storage body is not in the pressurizable state, or when the substitute mounting body is not mounted to the common mounting portion, since the pressurization supply unit is not driven, the wasteful driving of the pressurization supply unit does not occur. Therefore, it is possible to appropriately supply the liquid according to the mounting state of the liquid storage body.

The liquid supply system may further include a second liquid storage body mounting portion to and from which the second liquid storage body can be attached and detached, and a mounting detection unit capable of detecting whether or not the second liquid storage body is mounted to the second liquid storage body mounting portion. When the mounting detection unit detects that the second liquid storage body is mounted to the second liquid storage body mounting portion, the control unit may determine that the liquid which is stored in the second liquid storage body is in a pressurizable state.

In this case, when the second liquid storage body is mounted to the second liquid storage body mounting portion, since the liquid which is stored in the second liquid storage body is determined to be in the pressurizable state, it is possible to appropriately supply the liquid according to the mounting state of the second liquid storage body to the second liquid storage body mounting portion. Meanwhile, when the second liquid storage body is not mounted to the second liquid storage body mounting portion, since the pressurization supply unit is not driven, the wasteful driving of the pressurization supply unit does not occur.

In the liquid supply system, the substitute mounting body is detachably connected to the relay flow path via a first connection portion which may be provided on a downstream end of the relay flow path and a second connection portion which may be provided on the substitute mounting body, the common mounting portion may include an attachment portion to which the first connection portion is attached in a removable state, and an attachment detection unit capable of detecting whether or not the first connection portion is in a state of being attached to the attachment portion, and the control conditions may include the attachment detection unit detecting the first attachment unit being attached to the attachment portion.

In this case, since the driving of the pressurization supply unit is started after the attachment detection unit detects the fact that the first connection portion which is provided on the downstream end of the relay flow path is attached to the attachment portion of the common mounting portion, when the liquid is supplied, it is possible to reliably hold the relay flow path in the common mounting portion.

In the liquid supply system, in a state in which the first connection portion is attached to the attachment portion, the first connection portion may be connected to the second connection portion in a process of the substitute mounting body being mounted to the common mounting portion.

In this case, in the state in which the first connection portion is attached to the attachment portion, since the first connection portion is connected to the second connection portion in the process of the substitute mounting body being mounted to the common mounting portion, it is possible to confirm the connection between the substitute mounting body and the relay flow path due to the mounting target detection unit detecting the mounting of the substitute mounting body to the common mounting portion. In addition to this detection, since the fact that the common mounting portion, the substitute mounting body, and the relay flow path are connected to each other is confirmed by detecting the attachment of the first connection portion to the attachment portion, it is possible to appropriately supply the liquid which is stored in the second liquid storage body to the common mounting portion due to the pressurization supply unit being driven after the confirmation.

The liquid supply system may further include a restriction portion which is capable of restricting the substitute mounting body which is mounted to the common mounting portion from being detached and is capable of moving between a restriction position which restricts the substitute mounting body which is mounted to the common mounting portion from being detached and a restriction released position which allows the substitute mounting body which is mounted to the common mounting portion to be detached, and a restriction detection unit capable of detecting whether or not the restriction portion is in the restriction position. The control conditions may include the restriction detection unit detecting that the restriction portion is in the restriction position.

In this case, when the restriction detection unit detects that the restriction portion is in the restriction position, since it is conceivable that the substitute mounting body which is mounted to the common mounting portion is restricted from being detached, it is possible to appropriately supply the liquid in a state in which the substitute mounting body is reliably mounted to the common mounting portion.

The liquid supply system may further include a plurality of the common mounting portions. The control conditions may include the mounting target detection unit detecting that the first liquid storage body or the substitute mounting body is mounted to the common mounting portion.

In this case, since the driving of the pressurization supply unit is started when one or more of the first liquid storage bodies or the substitute mounting bodies are mounted to a plurality of the common mounting portions, it is possible to appropriately supply the liquid of the first liquid storage bodies or the second liquid storage bodies which are mounted to the plurality of common mounting portions.

According to an aspect of the invention, there is provided a liquid supply apparatus which includes a substitute mounting body which can be mounted, so as to be exchangeable with a first liquid storage body, to a common mounting portion to and from which the first liquid storage body capable of storing a liquid can be attached and detached, a relay flow path which communicates a second liquid storage body capable of storing a liquid with the substitute mounting body, a pressurization supply unit which supplies the liquid which is stored in the second liquid storage body to the substitute mounting body through the relay flow path under pressure, and a control unit which drives the pressure supply unit when a plurality of control conditions are satisfied, in which the control conditions include the liquid which is stored in the second liquid storage body entering a pressurizable state and the substitute mounting body being mounted to the common mounting portion.

In this configuration, it is possible to obtain the same effect as the liquid supply system.

According to still another aspect of the invention, there is provided a liquid ejecting apparatus which includes a liquid ejecting unit capable of ejecting a liquid, a common mounting portion into which a first liquid storage body capable of storing a liquid and a substitute mounting body which is connected to a second liquid storage body capable of storing a liquid via a relay flow path can be exchangeably mounted, a mounting target detection unit capable of detecting whether or not the first liquid storage body and the substitute mounting body are mounted to the common mounting portion, a pressurization supply unit which supplies the liquid which is stored in the second liquid storage body to the substitute mounting body under pressure, and a control unit which drives the pressure supply unit when a plurality of control conditions are satisfied, in which the control conditions include the liquid which is stored in the second liquid storage body entering a pressurizable state and the mounting target detection unit detecting mounting of the substitute mounting body to the common mounting portion.

In this configuration, it is possible to obtain the same effect as the liquid supply system.

According to still another aspect of the invention, there is provided a liquid supply method which is carried out by a liquid supply apparatus which includes a substitute mounting body which can be mounted, so as to be exchangeable with a first liquid storage body, to a common mounting portion to and from which the first liquid storage body capable of storing a liquid can be attached and detached, a relay flow path which communicates a second liquid storage body capable of storing a liquid with the substitute mounting body, and a pressurization supply unit which supplies the liquid which is stored in the second liquid storage body to the substitute mounting body through the relay flow path under pressure. The liquid supply method may cause the pressurization supply unit to start being driven when the liquid which is stored in the second liquid storage body enters a pressurizable state and the substitute mounting body is mounted to the common mounting portion.

In this configuration, it is possible to obtain the same effect as the liquid supply system.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, description will be given of the liquid supply system, the liquid supply apparatus, the liquid ejecting apparatus, and the liquid supply method, with reference to the drawings. An example of the liquid ejecting apparatus is an ink jet printer which performs recording (printing) by ejecting an ink, which is an example of the liquid, onto a medium such as paper.

First Embodiment

Overall Configuration

Figure 1A:
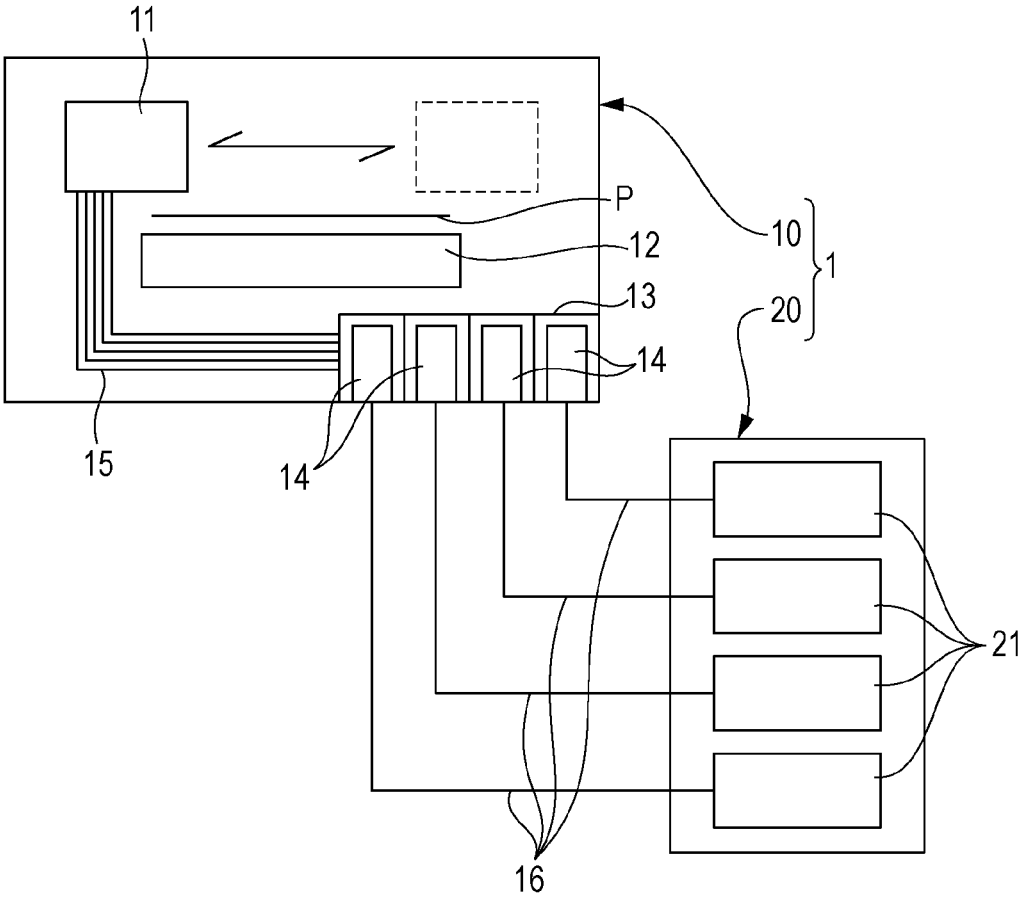
FIG. 1A is a diagram schematically illustrating a first embodiment of a liquid ejecting apparatus.

As illustrated in FIG. 1A, a liquid ejecting apparatus 1 is provided with a main body portion 10 and a storage unit 20. The main body portion 10 is provided with a liquid ejecting unit 11, a medium supporting portion 12, a medium transport mechanism (not shown), a head movement mechanism (not shown), and the like. The liquid ejecting unit 11 is capable of ejecting a liquid, and the medium supporting portion 12 is capable of supporting a medium P. The medium P is transported along the medium supporting portion 12 by the medium transport mechanism which is provided with a feed roller, a feed motor, and the like.

The liquid ejecting unit 11 is moved reciprocally by the head movement mechanism in a direction crossing the medium supporting portion 12. The head movement mechanism is provided with a carriage, a carriage guide shaft, a carriage movement mechanism, a carriage motor, and the like. The liquid ejecting unit 11 is mounted on the carriage, the carriage guide extends in the direction which crosses the medium supporting portion 12, and the carriage movement mechanism reciprocally moves the carriage along the carriage guide shaft. When the medium P passes the medium supporting portion 12, the printing is performed due to the liquid ejecting unit 11 ejecting the liquid onto the medium P.

The main body portion 10 is provided with a mounting portion 13. A relay apparatus 14 is mounted in the mounting portion 13 for each color of ink of cyan, magenta, yellow, and black. The liquid ejecting unit 11 and the relay apparatuses 14 are connected by flexible supply tubes 15. Note that, the relay apparatuses 14, the supply tubes 15, and the storage unit 20 form the liquid supply apparatus.

The storage unit 20 houses the same number (four, in the present embodiment) of main tanks 21 as relay apparatuses 14. The four main tanks 21 are supported by the support frame of the storage unit 20. The main tank 21 is pressurized by pressurized air which is pumped in from a pressurization unit (not shown) which is provided in the main body portion 10. The relay apparatuses 14 and the main tanks 21 are connected by flexible supply tubes 16. Note that, the number of relay apparatuses 14 and main tanks 21 may be a number other than four, and the types of liquid which are stored may differ from the four colors of ink described above.

Figure 1B:
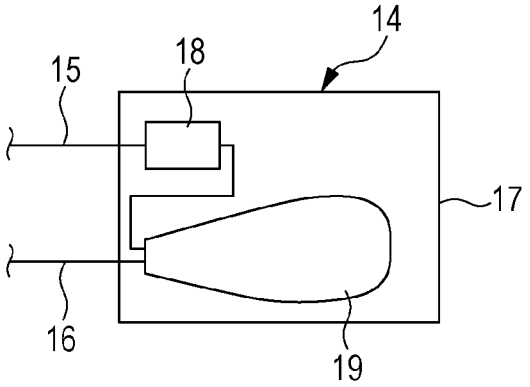
FIG. 1B is a diagram schematically illustrating the configuration of a relay apparatus.

As illustrated in FIG. 1B, the relay apparatus 14 is provided with a cartridge-shaped case 17 in addition to a filter 18 and a storage container 19 which are disposed on an inner portion of the case 17. The storage container 19 is a flexible tube container, and, for example, a blown bottle which has been created using blow-forming and is made of a resin is used as the storage container 19.

When the relay apparatus 14 is mounted in the mounting portion 13, a supply needle is inserted into a connection port which is provided in the case 17. Accordingly, the storage container 19 and the supply tube 15 are connected via the filter 18, and the storage container 19 and the supply tube 16 are connected to each other. When the main tank 21 is pressurized, the liquid which is stored in the main tank 21 is supplied to the relay apparatus 14, is stored temporarily, and is subsequently supplied from the relay apparatus 14 to the liquid ejecting unit 11.

Main Tank

Figure 2:
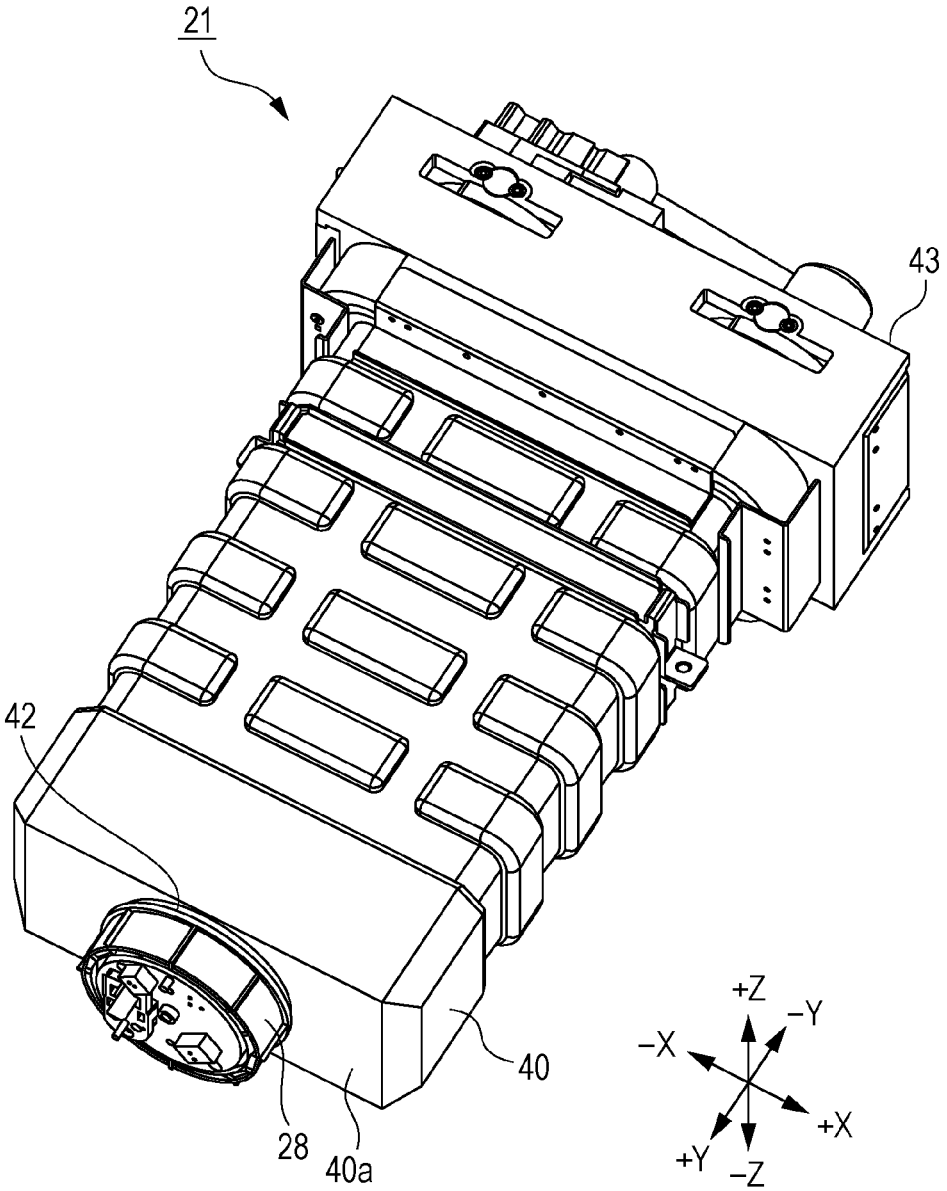
FIG. 2 is a perspective view of the exterior of a main tank.
Figure 3:
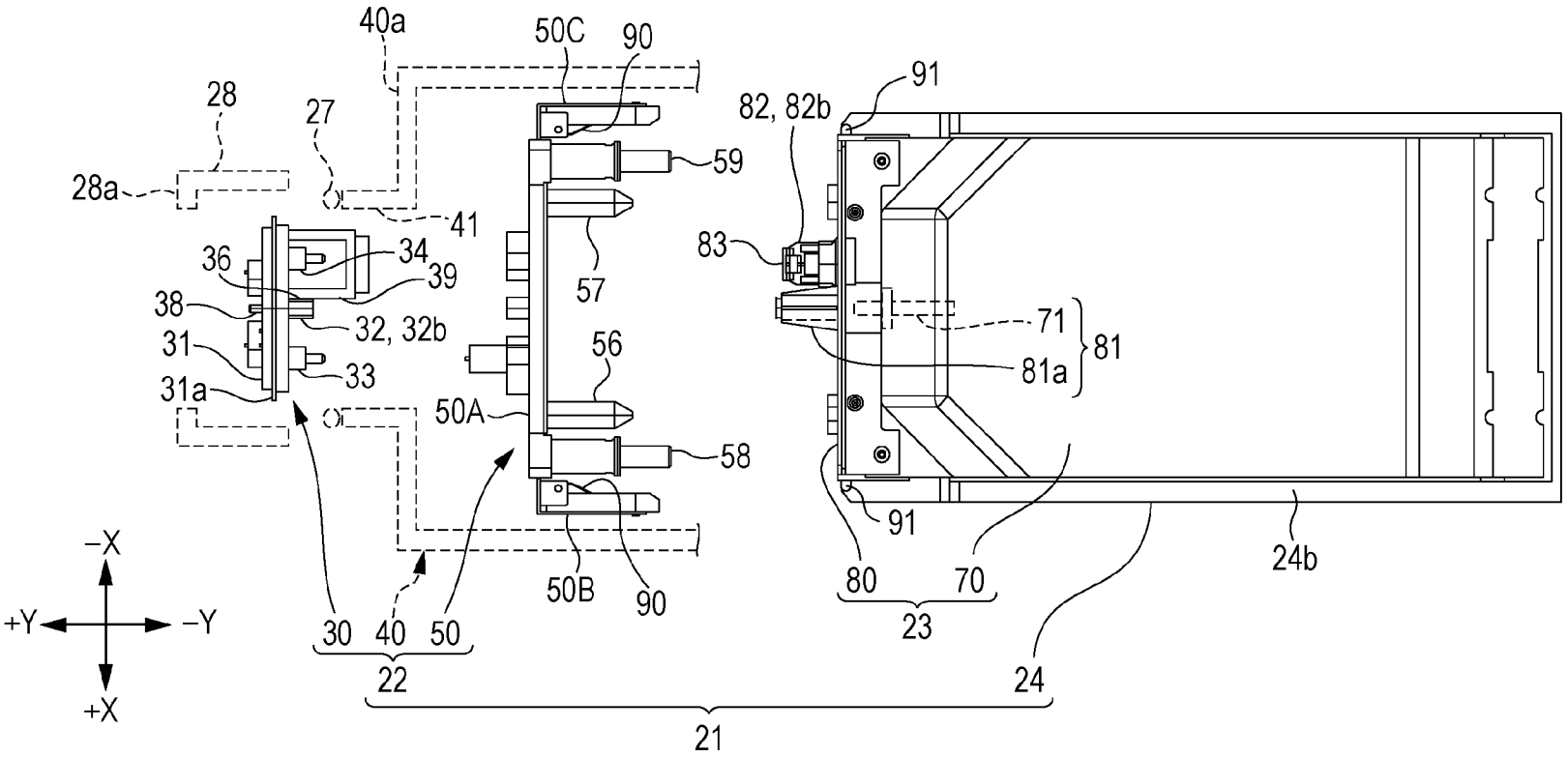
FIG. 3 is an exploded plan view of the main tank.

As illustrated in FIG. 3, the main tank 21 illustrated in FIG. 2 is provided with a container storage portion 22, and a tray 24. The container storage portion 22 is a sealed container, and the liquid container 23 is placed on the tray 24. The container storage portion 22 is provided with a circular cap body 30, a blown tank 40, and a mounting member 50. The blown tank 40 has been created using blow-forming and is made of a resin. The mounting member 50 is disposed on a reverse side of the cap body 30 in the inner portion of the blown tank 40.

In the description hereinafter, three directions which orthogonally intersect each other are defined as a container width direction X, a container front-rear direction Y, and a container vertical direction Z. One side and the other side in the container width direction X are respectively defined as the +X direction and the −X direction, one side and the other side in the container front-rear direction Y are respectively defined as the +Y direction and the −Y direction, and one side and the other side in the container vertical direction Z are respectively defined as the +Z direction and the −Z direction.

Opening and Closing Structure of Container Storage Portion

As illustrated in FIG. 2, the blown tank 40 is a container which is a substantially rectangular prism shape which is long in the container front-rear direction Y and is made of a resin. A circular opening 41 (refer to FIG. 3) is formed in the blown tank 40 and penetrates a container front surface portion 40*a* which is positioned on the end portion of the +Y direction side.

A cylindrical portion 42 which protrudes to the +Y direction side is formed at the opening edge of the circular opening 41. The cap body 30 is mounted to the distal end of the cylindrical portion 42 and seals the circular opening 41 in an airtight state. The cap body 30 is provided with a cap main body portion 31, which is substantially circular plate shaped, and a flange portion 31*a* overhangs the cap main body portion 31 from the outer circumferential end surface in a ring shape. An O-ring 27 (refer to FIG. 3) is disposed between the flange portion 31*a* and the distal end surface of the cylindrical portion 42.

An outside ring 28 (refer to FIGS. 2 and 3) is mounted to the outside of the cylindrical portion 42 and the cap body 30. The outer circumferential surface of the cylindrical portion 42 and the inner circumferential surface of the outside ring 28 oppose each other in the radial direction, and while a male screw portion is formed on one, a female screw portion is formed on the other. The outside ring 28 is mounted so as to cause the screw portions to engage with each other. An annular portion 28*a* which overhangs to the inner circumferential side is formed on the end portion of the +Y direction side of the outside ring 28. When the outside ring 28 is fastened, the annular portion 28*a* retains the flange portion 31*a* from the +Y direction side. Accordingly, the gap between the flange portion 31*a* and the cylindrical portion 42 is sealed by the O-ring 27.

Meanwhile, a rear side opening (not shown) which is open to the −Y direction is formed on the end portion of the opposite side from the circular opening 41 in the blown tank 40, and an opening and closing door 43 which opens and closes the rear side opening is attached. The opening and closing door 43 rocks around one end side in the container width direction X to open and close. The opening and closing door 43 is opened, and the liquid container 23 and the tray 24 are removed from and inserted into the blown tank 40 from the rear side opening. When the opening and closing door 43 is closed, the rear side opening is sealed in an airtight state.

Liquid Supply Portion

Figure 5A:
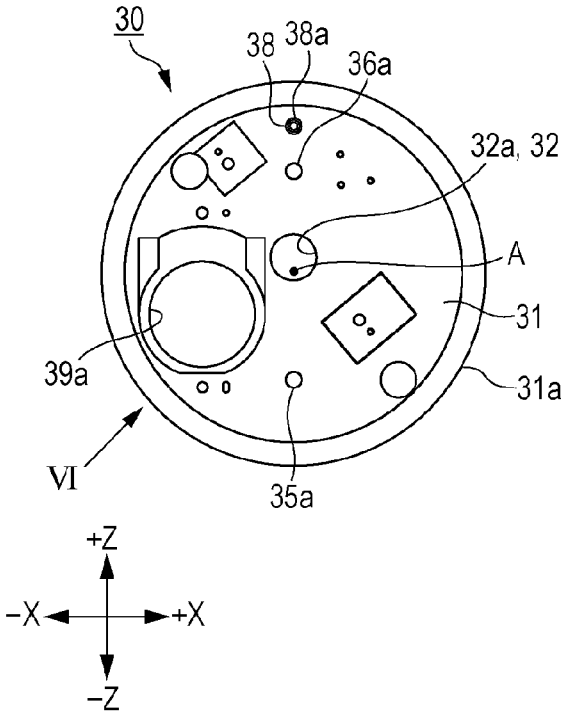
FIG. 5A is a front surface diagram of a cap body, as viewed from a +Y direction side.
Figure 6:
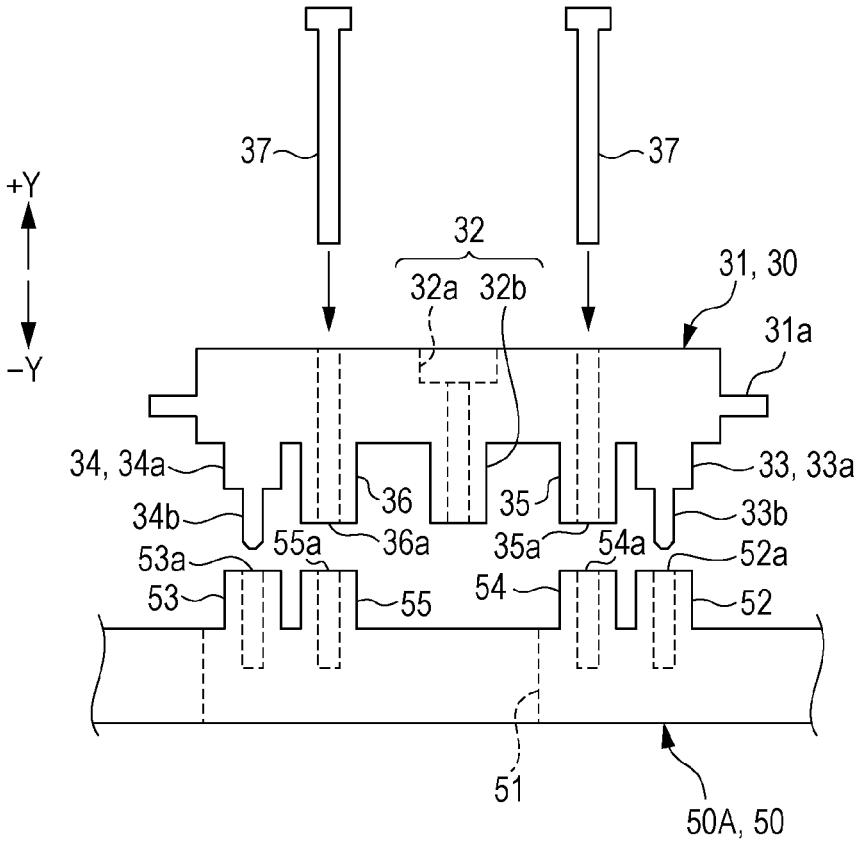
FIG. 6 is a diagram schematically illustrating a fixing structure between the cap body and a mounting member.

FIG. 6 is a diagram schematically illustrating the fixing structure between the cap body 30 and the mounting member 50 (a diagram as viewed from an arrow VI direction in FIG. 5A), and illustrates a state in which the mounting member 50 and the cap body 30 are separated from each other in the container front-rear direction Y.

Figure 5B:
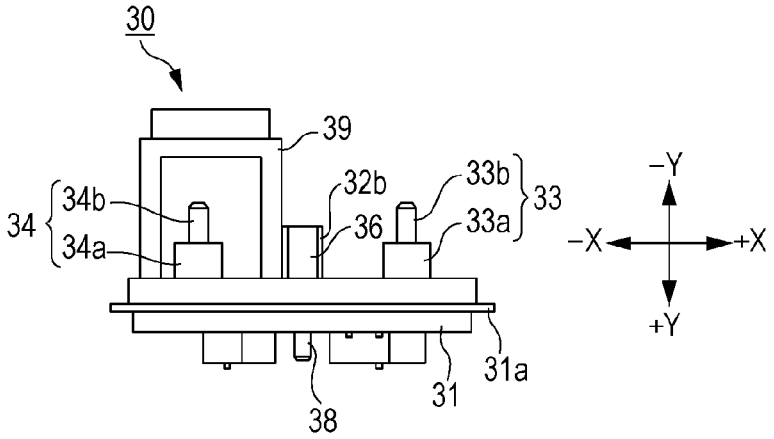
FIG. 5B is a side surface diagram of the cap body, as viewed from a +Z direction side.
Figure 5C:
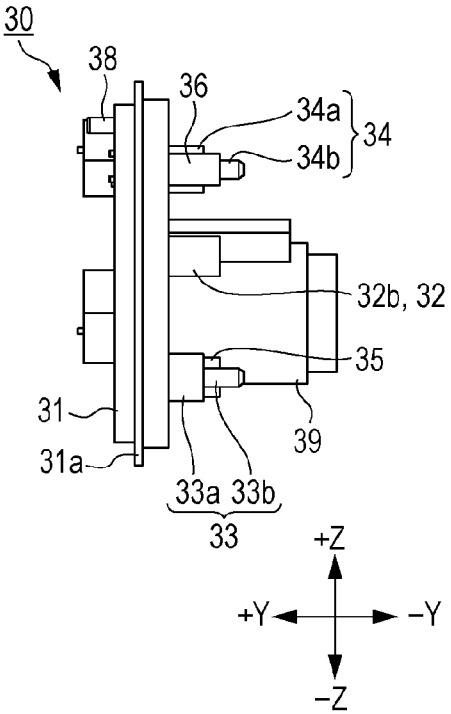
FIG. 5C is a side surface diagram of the cap body, as viewed from a +X direction side.

As illustrated in FIGS. 5A to 5C, the cap body 30 is mounted to the circular opening 41 of the blown tank 40 in a state of being capable of rotating around a center axis line of the cylindrical portion 42. The liquid supply portion 32 is provided in the cap body 30 in a position which is slightly shifted from the center of rotation A (refer to FIG. 5A).

The liquid supply portion 32 is provided with a connection port 32*a* and a protruding portion 32*b*. The opening of the connection port 32*a* is formed in the surface of the +Y direction side of the cap main body portion 31, and the protruding portion 32*b* protrudes in the −Y direction from a position of the reverse side of the connection port 32*a* in the cap main body portion 31. The supply tube 16 which forms a liquid flow path to the relay apparatus 14 is connected to the connection port 32*a*. A supply needle (not shown) is provided on the distal end of the protruding portion 32*b*, and a liquid flow path which communicates the connection port 32*a* with the supply needle is formed on the inner portion of the protruding portion 32*b*.

Figure 4:
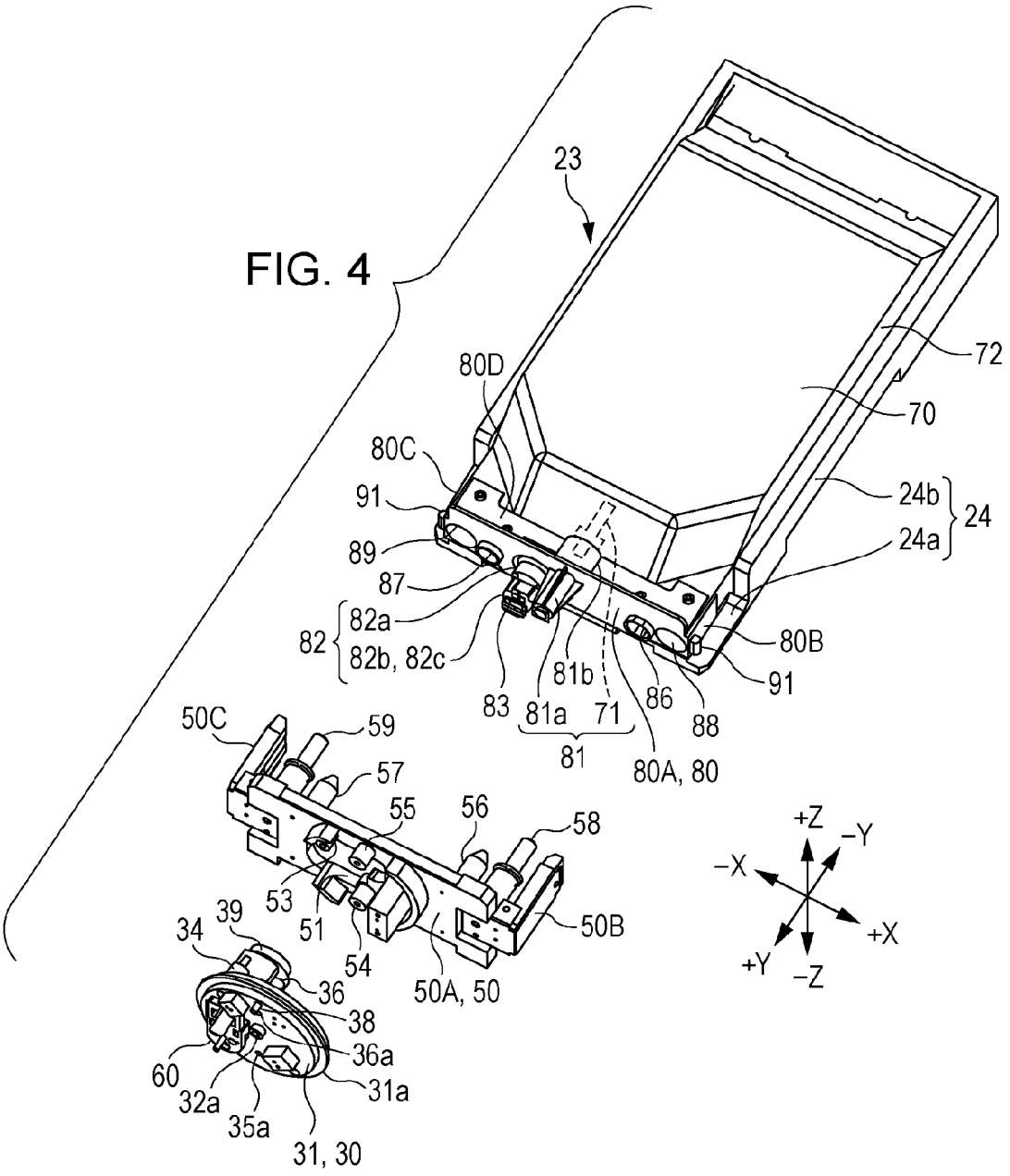
FIG. 4 is an exploded perspective view of the main tank.

As illustrated in FIG. 4, the mounting member 50 is provided with a mounting member main body portion 50A and end plate portions 50B and 50C. The mounting member main body portion 50A is a substantially rectangular shape which is long in the container width direction X, and each of the end plate portions 50B and 50C is provided on one of the end portions in the container width direction X of the mounting member main body portion 50A. A penetrating portion 51 is formed in a region of the mounting member main body portion 50A which overlaps the liquid supply portion 32 in the container front-rear direction Y. The penetrating portion 51 penetrates the mounting member main body portion 50A in the container front-rear direction Y. The mounting member 50 and the cap body 30 are disposed to interpose the cylindrical portion 42 of the blown tank 40, and are fixed by the fixing structure described hereinafter. At this time, the supply needle of the liquid supply portion 32 is facing the penetrating portion 51, and is facing the liquid container 23 which is mounted to the rear surface side of the mounting member main body portion 50A.

Fixing Structure of Cap Body and Mounting Member

As illustrated in FIGS. 5A to 5C, alignment protrusions 33 and 34 which protrude to the −Y direction side are provided in two symmetrical locations on the cap main body portion 31 to interpose the center of rotation A. The base end portion of the alignment protrusion 33 is a cylindrical large diameter portion 33*a*, and the distal end portion is a cylindrical small diameter portion 33*b* which has a smaller diameter than the large diameter portion 33*a*.

A tapered portion is formed on the distal end of the small diameter portion 33*b*. The closer to the distal end side, the smaller the diameter of the tapered portion becomes. The alignment protrusion 34 has the same shape as the alignment protrusion 33 and is provided with a large diameter portion 34*a* and a small diameter portion 34*b*.

Meanwhile, cylindrical protruding portions 52 and 53 (refer to FIGS. 4 and 6) are formed in positions which overlap the alignment protrusions 33 and 34 in the mounting member main body portion 50A in the container front-rear direction Y. The cylindrical protruding portions 52 and 53 protrude in the +Y direction from the mounting member main body portion 50A. Alignment holes 52*a* and 53*a* are formed in the end surfaces of the +Y direction sides of the cylindrical protruding portions 52 and 53. The alignment holes 52*a* and 53*a* are concave portions which do not penetrate the mounting member main body portion 50A, and the depth thereof is deeper than the lengths of the small diameter portions 33*b* and 34*b*.

Boss portions 35 and 36 are formed on the cap main body portion 31 in positions separated from the center of rotation A, at two locations in different positions from the alignment protrusions 33 and 34 in the circumferential direction. The boss portions 35 and 36 are disposed at two symmetrical locations to interpose the center of rotation A, and protrude from the cap main body portion 31 in the −Y direction. Fixing through-holes 35*a* and 36*a* which penetrate the cap main body portion 31 and the boss portions 35 and 36 in the container front-rear direction Y are formed in the cap body 30.

Meanwhile, boss portions 54 and 55 are formed in the mounting member main body portion 50A in positions which overlap the fixing through-holes 35*a* and 36*a* in the container front-rear direction Y. Fixing holes 54*a* and 55*a* are formed in the end surfaces of the +Y direction side of the boss portions 54 and 55. The fixing holes 54*a* and 55*a* are concave portions which do not penetrate the mounting member main body portion 50A.

As described above, the cap body 30 and the mounting member 50 interpose the cylindrical portion 42 which is provided on the opening edge of the circular opening 41 of the blown tank 40, from both sides in the container front-rear direction Y, and are fixed to each other by screws.

As illustrated in FIG. 6, when performing the fixing, first, the small diameter portions 33*b* and 34*b* of the alignment protrusions 33 and 34 which protrude from the cap body 30, and the alignment holes 52*a* and 53*a* of the cylindrical protruding portions 52 and 53 which protrude from the mounting member 50 are caused to face each other in the container front-rear direction Y. The mounting member 50 and the cap body 30 are caused to approach each other in the container front-rear direction Y, the small diameter portion 33*b* is inserted into the alignment hole 52*a*, and the small diameter portion 34*b* is inserted into the alignment hole 53*a*. At this time, the insertion of the small diameter portions 33*b* and 34*b* is guided by the tapered portion of the distal ends. The mounting member 50 is aligned with the cap body 30 in the container front-rear direction Y due to the distal end surfaces of the boss portions 54 and 55 abutting the distal end surfaces of the boss portions 35 and 36. At this time, the mounting member 50 and the cap body 30 are aligned in a relative rotation direction around the center of rotation A.

In this manner, when the mounting member 50 is aligned with the cap body 30, the fixing through-holes 35*a* and 36*a* of the cap body 30 side overlap the fixing through-holes 54*a* and 55*a* of the mounting member main body portion 50A side in the container front-rear direction Y. In this state, fixing screws 37 are attached to the fixing through-holes 35*a* and 36*a* from the outside of the tank (the +Y direction side), and the fixing screws 37 are fastened until the distal ends thereof are screwed into the fixing holes 54*a* and 55*a*. Accordingly, the mounting member 50 is fixed to the cap body 30 by screws.

Pressurizing Through-Hole

As illustrated in FIGS. 2 to 5C, a pressurization tube connection portion 38 is formed in the cap body 30 to protrude in the +Y direction to the outside of the fixing through-hole 35*a* in the radial direction. A pressurizing through-hole 38*a* (refer to FIGS. 5A to 5C) is formed in the distal end of the pressurization tube connection portion 38. The pressurizing through-hole 38*a* penetrates the pressurization tube connection portion 38 and the cap main body portion 31 in the container front-rear direction Y. The pressurization tube connection portion 38 is connected to the pressurization unit of the main body portion 10 by a pressurization tube.

When the circular opening 41 and the rear side opening are sealed, the inner portion of the container storage portion 22 becomes a sealed space. Pressurized air is pumped into the sealed space from the pressurizing through-hole 38*a*, and the container storage portion 22 is pressurized. As described above, since the fixing holes 54*a* and 55*a* and the alignment holes 52*a* and 53*a* which are used in fixing the cap body 30 to the mounting member 50 do not penetrate the mounting member 50, the pressurizing through-hole 38*a* and the liquid supply portion 32 are the only two locations in the container storage portion 22 which form communication portions with the outside.

Terminal Disposition Portion

As illustrated in FIGS. 5A to 5C, a terminal disposition portion 39 is provided in the cap body 30 between the alignment protrusion 33 and the fixing through-hole 36*a*. The terminal disposition portion 39 protrudes in the −Y direction from the cap main body portion 31. When the cap body 30 is fixed to the mounting member 50, the terminal disposition portion 39 is disposed on the penetrating portion 51 of the mounting member main body portion 50A and protrudes into the space in which the liquid container 23 is disposed. A penetrating portion 39*a* which penetrates the terminal disposition portion 39 in the container front-rear direction Y is formed therein.

The opening of one end of the penetrating portion 39*a* is formed in the distal end surface (the end surface of the −Y direction side) of the terminal disposition portion 39, and the opening of the other end is formed in the surface of the +Y direction side of the cap main body portion 31. The connector unit 60 (refer to FIGS. 2 and 4) is mounted to the penetrating portion 39*a*. A substrate holding portion 82 (refer to FIGS. 3 and 4) which is provided on the front end of the liquid container 23 is inserted into the penetrating portion 39*a* in the +Y direction. Note that, FIGS. 5A to 5C illustrate a state in which the connector unit 60 is not mounted to the terminal disposition portion 39 of the cap body 30. Detailed description will be given of the connector unit 60 and the substrate holding portion 82 later.

Liquid Container

Figure 7:
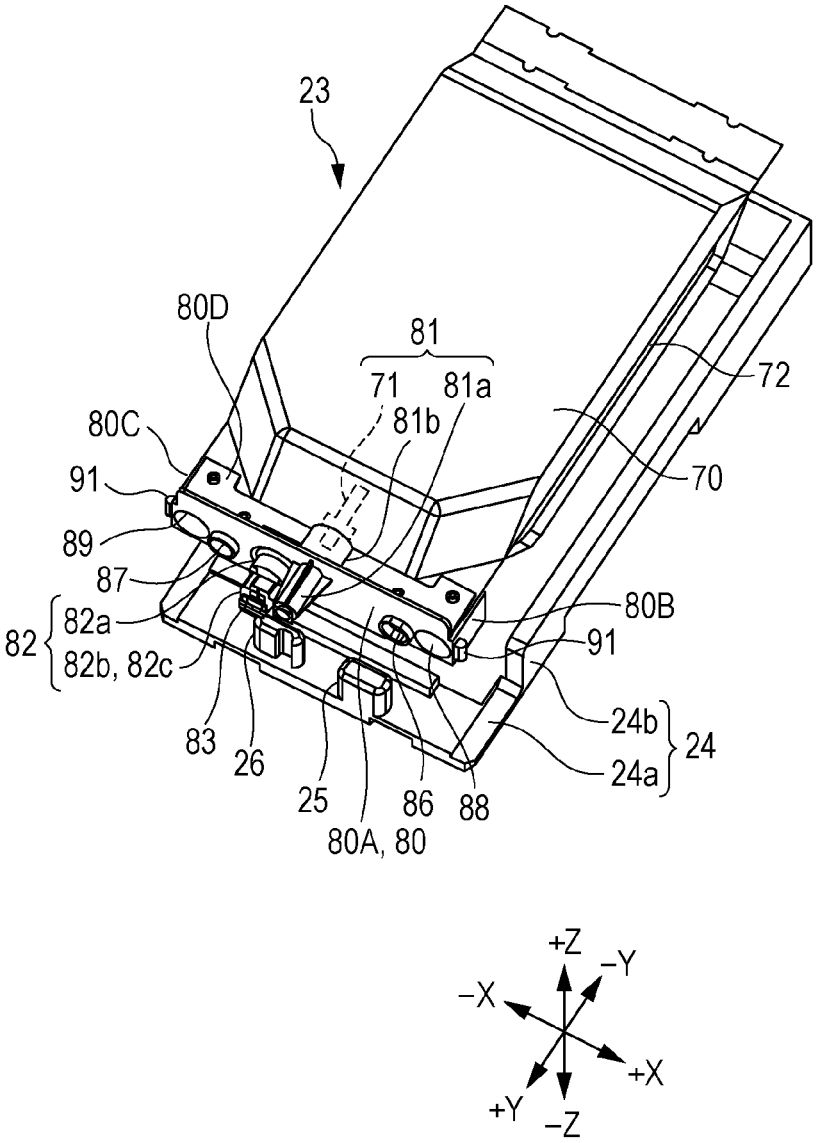
FIG. 7 is a perspective view illustrating a state in which a liquid container is lifted from a tray.

As illustrated in FIG. 7, the liquid container 23 is provided with a liquid storage pouch 70, and an adapter 80. The liquid storage pouch 70 is long in the container front-rear direction Y, and the adapter 80 is attached to one end of the liquid storage pouch 70 in the longitudinal direction. The removal and the insertion of the liquid container 23 from and to the container storage portion 22 is performed in a state in which the liquid container 23 is placed on the tray 24.

Liquid Storage Pouch

As illustrated in FIG. 7, the liquid storage pouch 70 is flexible and a liquid is sealed in the inner portion thereof. The planar shape of the liquid storage pouch 70 is substantially rectangular, and is of a size which fits on the tray 24. A communication portion 71 which communicates the inside of the liquid storage pouch 70 with the outside thereof is formed on the end portion of the +Y direction side of the liquid storage pouch 70. The liquid storage pouch 70 maintains a sealed state except for the communication portion 71. The communication portion 71 is formed by attaching a pipe-shaped part to the edge of the flexible pouch body.

A gusset portion 72 is formed on each of the side surfaces of the +X direction side and the −X direction side of the liquid storage pouch 70. When the amount of the liquid with which the liquid storage pouch 70 is filled is great, the gusset portion 72 stretches in the container vertical direction Z, and the volume of the liquid storage pouch 70 is great. When the liquid is pumped out from the liquid storage pouch 70 and the amount of liquid is reduced, the gusset portion 72 folds up, the liquid storage pouch 70 becomes thinner, and the capacity is reduced.

Adapter

As illustrated in FIG. 7, in a state in which the liquid container 23 is placed on the tray 24 with the adapter 80 leading, the liquid container 23 is inserted into the container storage portion 22 from the rear side opening thereof in the mounting direction B (in the present embodiment, the +Y direction). The adapter 80 is provided with a front plate portion 80A, end plate portions 80B and 80C, and an attachment portion 80D. The front plate portion 80A is long in the container width direction X, each of the end plate portions 80B and 80C is provided on one of the sides in the container width direction X of the front plate portion 80A, and the attachment portion 80D is provided on the rear surface side (the −Y direction side) of the front plate portion 80A. The attachment portion 80D is fixed to interpose the edge of the +Y direction side of the liquid storage pouch 70. The end plate portions 80B and 80C extend in the −Y direction from the both ends of the front plate portion 80A.

Ink Outlet Portion

Figure 8A:
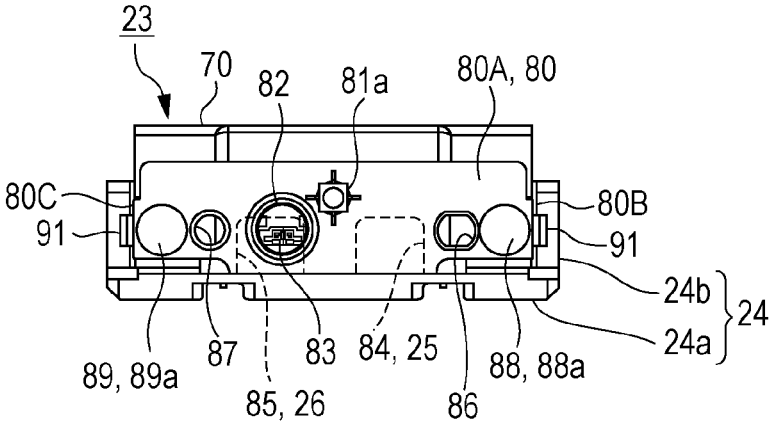
FIG. 8A is a front view illustrating a state in which the liquid container is placed on the tray.
Figure 8B:
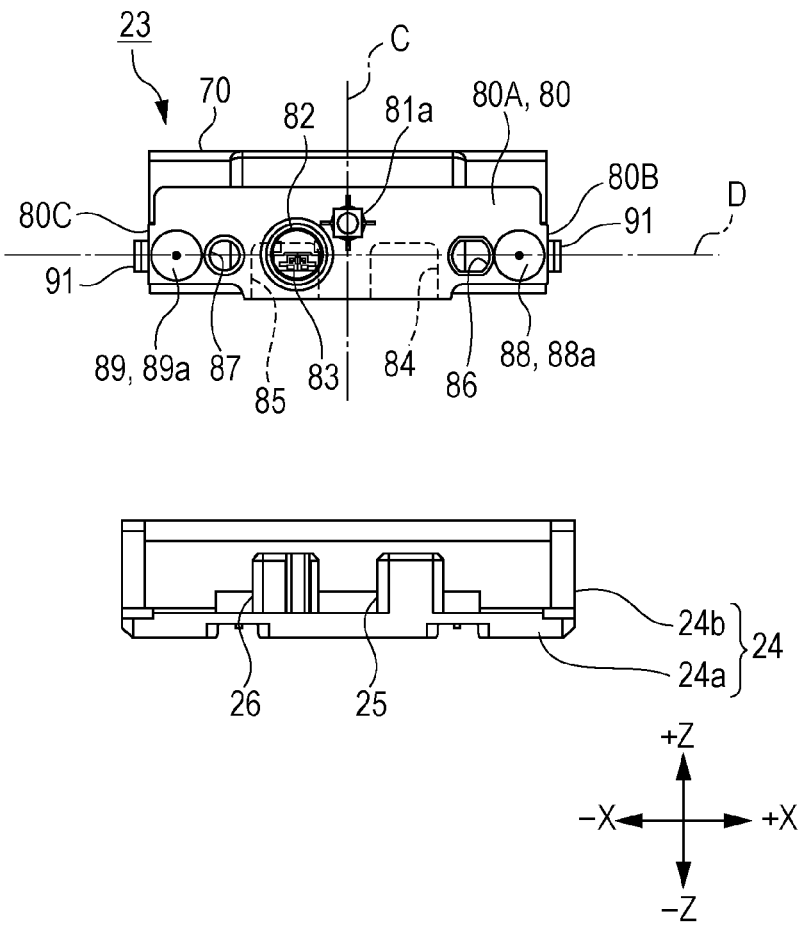
FIG. 8B is a front view illustrating a state in which the liquid container is lifted from the tray.

As illustrated in FIGS. 7 to 8B, the front plate portion 80A is provided with a substantially rectangular adapter front end surface which faces the +Y direction. A protruding portion 81*a* which protrudes in the +Y direction is formed in the center of the front plate portion 80A in the container width direction X. On the reverse side (the −Y direction side) of the protruding portion 81*a*, a ridge portion 81*b* which is formed on the top surface (the +Z direction surface) of the attachment portion 80D extends in the container front-rear direction Y.

The adapter 80 is provided with a liquid flow path which penetrates the protruding portion 81*a* and the ridge portion 81*b* in the container front-rear direction Y, and the opening of one end of the liquid flow path is formed in the distal end surface of the protruding portion 81*a*. The other end of the liquid flow path is connected to the communication portion 71 of the liquid storage pouch 70. A liquid outlet portion 81 (the liquid outlet portion) which allows the liquid to flow out from the liquid storage pouch 70 is formed of the protruding portion 81*a*, the ridge portion 81*b*, and the communication portion 71.

The liquid outlet portion 81 is connected to the liquid supply portion 32 of the cap body 30 when the liquid container 23 is mounted to the container storage portion 22. Therefore, the liquid which is pumped from the liquid outlet portion 81 is supplied to the relay apparatus 14 via the liquid supply portion 32 and the supply tube 16. At this time, when the container storage portion 22 is pressurized, the liquid storage pouch 70 is crushed by the air pressure, and the pumping out of the liquid in the inner portion thereof is promoted.

Engagement Structure of Liquid Container and Tray

As illustrated in FIGS. 7 to 8B, tray 24 on which the liquid container 23 is mounted is provided with a rectangular bottom plate portion 24*a* and a side wall portion 24*b*. The bottom plate portion 24*a* is long in the container front-rear direction Y, and the side wall portion 24*b* protrudes in the +Z direction along the edges of the three directions of the +X direction side, the −Y direction side, and the −X direction side of the bottom plate portion 24*a*. In the tray 24, a first engagement portion 25 and a second engagement portion 26 are provided on the edge of the +Y direction side of the bottom plate portion 24*a*. The first engagement portion 25 and the second engagement portion 26 are protruding portions which protrude from the bottom plate portion 24*a* in the +Z direction, and are disposed to be separated from each other in the container width direction X.

The liquid container 23 is disposed on the edge of the +Y direction side of the tray 24 such that the adapter 80 sits on the tray 24. As illustrated in FIGS. 8A and 8B, when the front plate portion 80A of the adapter 80 is disposed on the front end of the tray 24, a first engagement target portion 84 is formed in a position which overlaps the first engagement portion 25 in the container vertical direction Z, and a second engagement target portion 85 is formed in a position which overlaps the second engagement portion 26 in the container vertical direction Z. The first engagement target portion 84 and the second engagement target portion 85 are both concave portions which are open in the −Z direction.

When the liquid container 23 is placed on the tray 24, the first engagement portion 25 engages with the first engagement target portion 84 in the container vertical direction Z, and the second engagement portion 26 engages with the second engagement target portion 85 in the container vertical direction Z. Accordingly, the liquid container 23 is aligned with the tray 24 in the container width direction X and the container front-rear direction Y.

Connection Between Circuit Board and Connection Terminal

As illustrated in FIG. 7, the substrate holding portion 82 (the protrusion) which protrudes in the +Y direction is formed on the −X direction side of the protruding portion 81*a* in the front plate portion 80A. The substrate holding portion 82 is provided with a substantially cylindrical base end portion 82*a*, and a substrate attachment portion 82*b* which protrudes further in the +Y direction from the distal end surface of the base end portion 82*a*. An inclined surface 82*c* is formed on the distal end of the substrate attachment portion 82*b*. The inclined surface 82*c* is a surface which is obtained by inclining the XZ plane in an inclination direction which moves in the +Y direction approaching the −Z direction.

The O-ring (not shown) is mounted to the outer circumference of the foot of the base end portion 82*a*. When the liquid container 23 is mounted to the container storage portion 22, the substrate holding portion 82 is inserted into the penetrating portion 39*a* (refer to FIG. 5A) of the terminal disposition portion 39 which is protruding to the reverse side of the cap body 30. The substrate holding portion 82 faces the connector unit 60 (refer to FIGS. 4 and 9A to 9C), which is mounted in the penetrating portion 39*a* from the +Y direction, in the container front-rear direction Y.

Figure 9A:
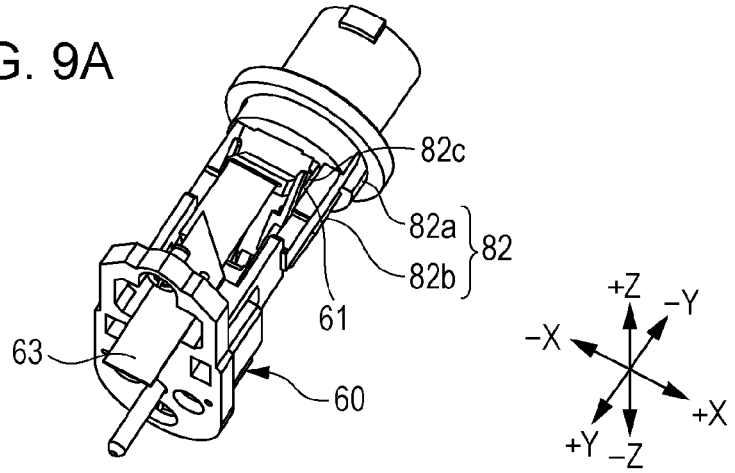
FIGS. 9A and 9C are perspective views of a connector unit and a substrate holding portion.
Figure 9B:
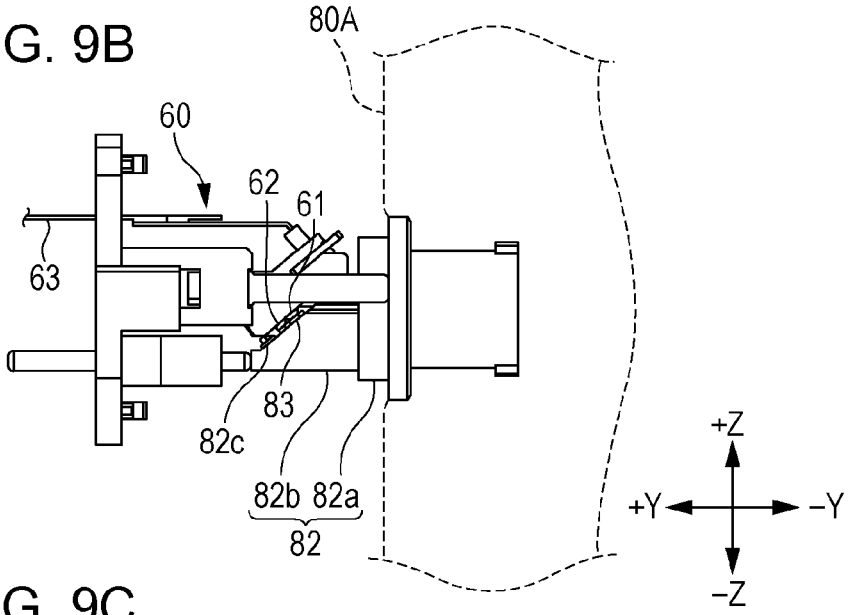
FIG. 9B is a side surface view of the connector unit and the substrate holding portion.
Figure 9C:
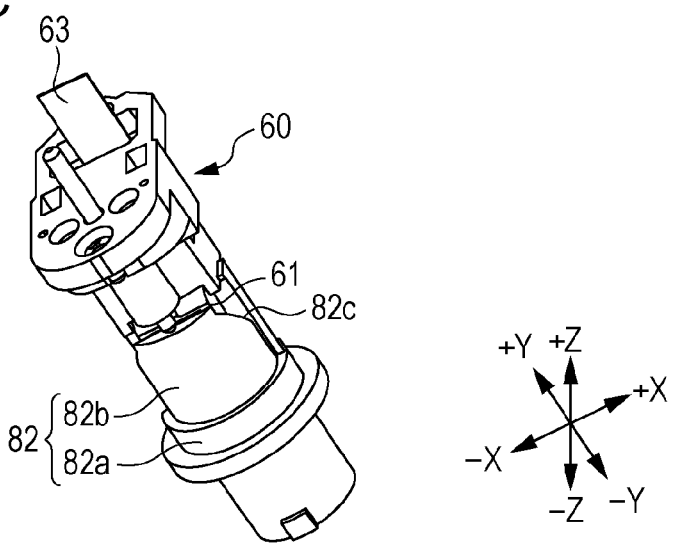

As illustrated in FIGS. 9A to 9C, the substrate holding portion 82 is formed to mount a separate part to the mounting through-hole which is formed in the front plate portion 80A of the adapter 80. Note that, the substrate holding portion 82 may be formed integrally with the front plate portion 80A. The circuit board 83 is attached to the inclined surface 82*c* of the substrate holding portion 82. The circuit board 83 is a circuit board in which memory elements, which store the amount of the liquid which is inside the liquid container 23 and the like, are provided.

An inclined surface 61 which faces the inclined surface 82*c* of the substrate holding portion 82 is provided on the connector unit 60. The inclined surface 61 is a surface which is parallel with the inclined surface 82*c*, and is disposed inside the penetrating portion 39*a* when the connector unit 60 is mounted to the terminal disposition portion 39 of the cap body 30. A connection terminal 62 is disposed on the inclined surface 61. A wiring 63 which is conductively connected to the connection terminal 62 is routed to the rear surface side of the inclined surface 61. The wiring 63 is routed from the connector unit 60 to the front surface side of the cap body 30, and is routed to the main body portion 10 side together with the supply tube 16 for supplying the liquid.

When the liquid container 23 is mounted to the container storage portion 22, the substrate holding portion 82 is inserted into the penetrating portion 39*a* of the cap body 30 as the liquid container 23 moves in the mounting direction B. As illustrated in FIGS. 9A to 9C, when the mounting of the liquid container 23 to the container storage portion 22 is complete, a state is assumed in which the terminal portion on the circuit board 83 which is disposed on the inclined surface 82*c* of the adapter 80 side is in contact with the connection terminal 62 which is disposed on the inclined surface 61 of the connector unit 60 side. Accordingly, the connection between the circuit board 83 and the connection terminal 62 is formed.

Alignment of Liquid Container and Shock Absorption Using Damper

As illustrated in FIGS. 8A and 8B, a first guide through-hole 86 and a second guide through-hole 87 (liquid container side alignment portions) which are open to the +Y direction are formed in the front plate portion 80A of the adapter 80. The first guide through-hole 86 and the second guide through-hole 87 are disposed to mirror each other in the container width direction X, using the YZ plane (the YZ plane containing the C-C line in FIG. 8B) as a reference. The YZ plane passes through the center of the distal end of the protruding portion 81*a* of the liquid outlet portion 81.

The first guide through-hole 86 is disposed on the +X direction side in relation to the protruding portion 81*a*, and the second guide through-hole 87 is disposed on the −X direction side in relation to the protruding portion 81*a*. The first guide through-hole 86 and the second guide through-hole 87 penetrate the front plate portion 80A in the container front-rear direction Y. The first guide through-hole 86 is a long hole which is narrow and long in the container width direction X. Meanwhile, the second guide through-hole 87 is a circular through-hole.

A first concave portion 88 and a second concave portion 89 are formed in the front plate portion 80A of the adapter 80. The first concave portion is formed further to the +X direction side than the first guide through-hole 86, and the second concave portion 89 is formed further to the −X direction side than the second guide through-hole 87. The first concave portion 88 and the second concave portion 89 are concave portions which are concave in the −Y direction.

The first concave portion 88 and the second concave portion 89 are disposed to mirror each other in the container width direction X, using the C-C line as a reference, and are disposed at equal distances from the protruding portion 81*a* of the liquid outlet portion 81. The first concave portion 88, the first guide through-hole 86, the second guide through-hole 87, and the second concave portion 89 are disposed on a straight line which is parallel to the container width direction X in the front end surface of the adapter. The liquid outlet portion 81 is disposed closer to the container top side (the +Z direction side) than the positions in which the abovementioned components are arranged. The center of a bottom surface 88*a* of the first concave portion 88 and the straight line D which passes through the center of the bottom surface 89*a* of the second concave portion 89 overlap the first and second engagement target portions 84 and 85 which are the parts which engage with the tray 24 in the adapter 80 (refer to FIGS. 8A and 8B).

Meanwhile, as illustrated in FIG. 3, the mounting member 50 is provided with two guide pins 56 and 57 (mounting member side engagement portions) which protrude from the mounting member main body portion 50A in the −Y direction. The guide pin 56 is disposed on the +X direction side in relation to the penetrating portion 51, and the guide pin 57 is disposed on the −X direction side in relation to the penetrating portion 51. Dampers 58 and 59 (buffering portions) are disposed on the outside of the container width direction X in relation to the guide pins 56 and 57.

The damper 58 is disposed on the +X direction side in relation to the guide pin 56, and the damper 59 is disposed on the −X direction side in relation to the guide pin 57. The distal end portions of the dampers 58 and 59 protrude from the mounting member main body portion 50A in the −Y direction. The damper 58, the guide pin 56, the guide pin 57, and the damper 59 are disposed on a straight line which is parallel to the container width direction X.

The liquid container 23 is inserted into the container storage portion 22 by causing the adapter 80, which is disposed to lead the liquid container 23, to face the mounting member 50 in the container front-rear direction Y. At this time, the guide pin 56 of the mounting member 50 faces the first guide through-hole 86 of the adapter 80, and the guide pin 57 of the mounting member 50 faces the second guide through-hole 87.

The damper 58 of the mounting member 50 faces the first concave portion 88 of the adapter 80, and the damper 59 of the mounting member 50 faces the second concave portion 89 of the adapter 80. When the liquid container 23 is moved in the mounting direction B, the adapter 80 which is disposed to lead the liquid container 23 approaches the mounting member 50. At this time, at first, the insertion of the dampers 58 and 59 to the first and second concave portions 88 and 89 is started. Subsequently, the insertion of the guide pins 56 and 57 to the first and second guide through-holes 86 and 87 is started before the distal ends of the dampers 58 and 59 make contact with the bottom surfaces 88*a* and 89*a* of the first and second concave portions 88 and 89.

The guide pins 56 and 57 are inserted into the first and second guide through-holes 86 and 87 while being guided by the tapered portions which are formed on the distal ends of the guide pins 56 and 57. The guide pins 56 and 57 are shaped as cylinders with fixed diameters except for the tapered portions. When the cylindrical portions of the guide pins 56 and 57 are inserted into the first and second guide through-holes 86 and 87, the adapter 80 is aligned on the XZ plane in relation to the mounting member 50. At this time, since the second guide through-hole 87 is circular, the second guide through-hole 87 serves as a reference for the alignment.

Meanwhile, since the other first guide through-hole 86 is a long through-hole, the first guide through-hole 86 serves to prevent the rotation of the adapter 80 in relation to the mounting member 50. After the alignment on the XZ plane using the guide pins 56 and 57 and the first and second guide through-holes 86 and 87 is completed, the distal ends of the dampers 58 and 59 abut the bottom surfaces 88*a* and 89*a* (abutting portions: refer to FIGS. 8A, 8B, and 10) of the first and second concave portions 88 and 89.

The dampers 58 and 59 are air dampers which are capable of expanding and contracting in the container front-rear direction Y. The detailed configuration of the dampers 58 and 59 will be described later. The dampers 58 and 59 abut the bottom surfaces 88*a* and 89*a* of the first and second concave portions 88 and 89, and subsequently, are compressively pressed in the +Y direction with the further movement of the liquid container 23 in the mounting direction B.

At this time, the dampers 58 and 59 generate a buffering force which counters the inertial force of the liquid container 23 which moves in the mounting direction B. Accordingly, after the dampers 58 and 59 abut the bottom surfaces 88*a* and 89*a* of the first and second concave portions 88 and 89, the impact force which acts on the colliding parts of the container storage portion 22 and the liquid container 23 is reduced by the buffering action of the abutting.

As described above, the liquid container 23 is provided with the liquid outlet portion 81 which protrudes from the adapter 80 in the +Y direction. Meanwhile, the container storage portion 22 is provided with the liquid supply portion 32 which protrudes from the penetrating portion 51 of the mounting member 50 to the liquid container 23 side. When the positioning of the adapter 80 on the XZ plane in relation to the mounting member 50 is performed by the guide pins 56 and 57, the liquid outlet portion 81 of the liquid container 23 faces the liquid supply portion 32 of the container storage portion 22.

The liquid outlet portion 81 is connected to the liquid supply portion 32 after a state is assumed in which the compression of the dampers 58 and 59 is started and the buffering action occurs. A seal member (not shown) is provided on the distal end portion of the liquid outlet portion 81. The seal member is biased in the +Y direction by a spring seat. When the liquid outlet portion 81 is not connected to the liquid supply portion 32, the seal member seals the liquid outlet portion 81 and stops the liquid from flowing out.

When the liquid outlet portion 81 is connected to the liquid supply portion 32, the seal member is compressed to move in the −Y direction by the supply needle, and, as a result, the flow path within the liquid outlet portion 81 and the flow path within the liquid supply portion 32 are communicated.

After the liquid supply portion 32 is connected to the liquid outlet portion 81, the liquid container 23 is moved further in the mounting direction B (the +Y direction). At this stage, the connection between the connection terminal 62 and the circuit board 83 is performed. The connection terminal 62 is held in the cap body 30 of the container storage portion 22, and the circuit board 83 is held in the adapter 80 of the liquid container 23. In other words, when the liquid supply portion 32 is connected to the liquid outlet portion 81, the substrate holding portion 82 which holds the circuit board 83 is already inserted into the distal end side of the penetrating portion 39*a* to which the connector unit 60 is attached.

If the liquid container 23 is moved further in the mounting direction B from this state, first, the O-ring (not shown) which is mounted in the base end portion 82*a* of the substrate holding portion 82 is crushed by the distal end surface of the terminal disposition portion 39. Accordingly, the penetrating portion 39*a* stops communicating with the pressurized space inside the container storage portion 22, and it is possible to perform the connection of the circuit board 83 to the connection terminal 62 outside of the pressurized space.

Subsequently, inside the penetrating portion 39*a*, the connection terminal 62 which is attached to the inclined surface 61 of the connector unit 60 makes contact with the circuit board 83 which is attached to the inclined surface 82*c* of the substrate attachment portion 82*b*. The circuit board 83 and the connection terminal 62 make sliding contact along the inclination direction of the inclined surfaces 61 and 82*c* when the contact is made.

As described above, the liquid container 23 is mounted to the container storage portion 22 by undergoing the five steps (1) to (5) described below.

(1) Align the tray 24 and the liquid container 23 using two engagement portions.

(2) Align the mounting member 50 and the liquid container 23 using the two guide pins 56 and 57.

(3) A buffering action is generated by the dampers 58 and 59.

(4) The liquid supply portion 32 is connected to the liquid outlet portion 81.

(5) The connection terminal 62 of the container storage portion 22 side makes contact with the circuit board 83 of the liquid container 23 side.

Release-Stop Structure of Liquid Container

When the liquid container 23 is mounted to the container storage portion 22, the end plate portion 80B of the adapter 80 is positioned on the inside of the container width direction X of the end plate portion 50B of the mounting member 50, and the end plate portion 80C is positioned on the inside of the container width direction X of the end plate portion 50C of the mounting member 50. A plate spring 90 is attached to the inside surface in the container width direction X of each of the end plate portions 50B and 50C.

Meanwhile, a locking portion 91 is formed on each of the end plate portions 80B and 80C. The locking portions 91 are protrusions which protrude from the outside surfaces of the end plate portions 80B and 80C in the container width direction X. When the liquid container 23 moves in the mounting direction B within the container storage portion 22, the plate springs 90 and the locking portions 91 engage at the two locations between the end plate portion 50B and the end plate portion 80B, and between the end plate portion 50C and the end plate portion 80C.

When the five steps described above, (1) to (5), are completed, the engagement between the plate springs 90 and the locking portions 91 at both end portions of the liquid container 23 in the container width direction X is also completed. The locations at which the plate springs 90 are engaged with the locking portions 91 will not be disengaged by a degree of force exerted by weak vibrations. Accordingly, the plate springs 90 and the locking portions 91 function as release-stops for the liquid container 23 during vibration. Meanwhile, the engagement locations will be easily disengaged by a degree of force exerted by a user pulling the liquid container 23. Accordingly, it is easy to exchange the liquid containers 23.

Damper

Figure 10:
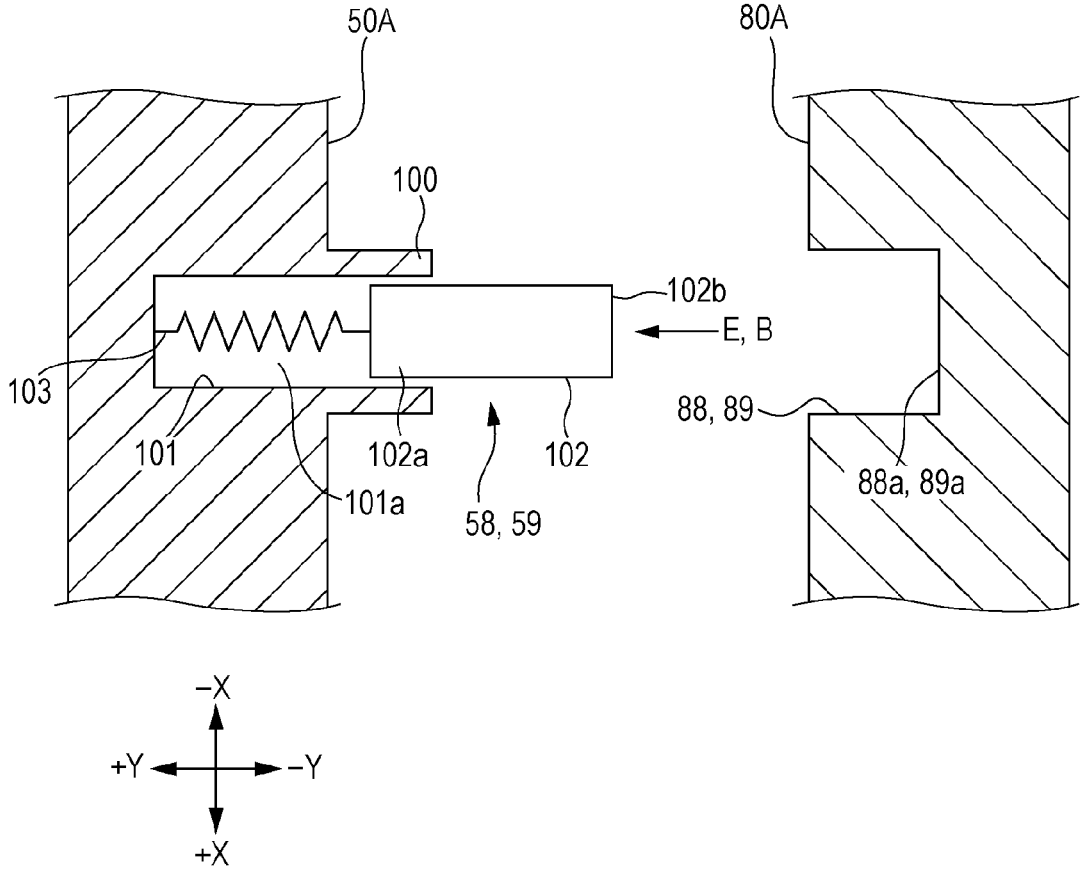
FIG. 10 is a diagram schematically illustrating the configuration of a damper.

As illustrated in FIG. 10, the dampers 58 and 59 are air dampers in which a buffering force is generated by compressing air. The dampers 58 and 59 have the same configuration. A protruding portion 100 which protrudes in the −Y direction is formed in each formation position of the dampers 58 and 59 in the mounting member main body portion 50A.

Each of the dampers 58 and 59 is provided with a concave portion 101, a linear piston 102 (a movement unit), and a coil spring 103 (a biasing portion). The concave portion 101 is formed in the distal end surface of the protruding portion 100, one end of the piston 102 is inserted into a space (a concave portion space 101*a*) inside the concave portion 101, and the coil spring 103 is disposed in the concave portion space 101*a*. The concave portion 101 is concave in a linear shape in the +Y direction. An end portion 102*a* of the +Y direction side of the piston 102 is inserted into the concave portion space 101*a*. The end portion 102*a* makes contact with the inner circumferential surface of the concave portion 101 from the inside, and locks the concave portion space 101*a* in an airtight state.

The piston 102 is capable of reciprocal movement in a compression direction E in which the air of the concave portion space 101*a* is compressed, and in the reverse direction. The dampers 58 and 59 are formed such that the compression direction E and the mounting direction B of the liquid container 23 match. In the present embodiment, the compression direction E and the mounting direction B are both the +Y direction. The coil spring 103 is of a free length in the state in which the coil spring 103 is not being compressed by the piston 102.

An end portion 102*b* of the other side of the piston 102 faces the bottom surface 88*a* (89*a*) of the first concave portion 88 (the second concave portion 89) of the adapter 80. When the liquid container 23 moves in the mounting direction B (the +Y direction), the piston 102 abuts the bottom surface 88*a* (89*a*), and the liquid container 23 is pressed to move in the compression direction E (the +Y direction or the mounting direction B) by the bottom surface 88*a* (89*a*).

At this time, since the length of the damper 58 (59) is compressed, and the air which is sealed in the concave portion 101 is compressed, a restorative force which acts to restore the piston 102 acts in the opposite direction from the compression direction E. At this time, since the coil spring 103 is compressed, the piston 102 is biased in the opposite direction (the −Y direction) to the compression direction E by the coil spring 103.

The restorative force and the biasing force act on the liquid container 23 in the opposite direction to the mounting direction B, and increases as the piston 102 moves in the +Y direction. When the liquid container 23 is pressed by the damper 58 (59), a buffering action is caused by the restorative force and the biasing force, and the shock which occurs when the liquid container 23 collides with the container storage portion 22 is reduced.

Accordingly, the shock which is applied to the locations (in particular, the liquid supply portion 32 and the liquid outlet portion 81) which make contact when the liquid container 23 is mounted to the container storage portion 22. Note that, a configuration may be adopted in which a minute communication portion which communicates with the outside of the mounting member main body portion 50A is provided in one of the surfaces or the opening side of the concave portion space 101*a*, and the compressed air slowly escapes. Accordingly, the behavior during insertion is softened, and the shock when the collision occurs is reduced. Since the compressed air of the concave portion space 101*a* escapes and the restorative force is weakened, it is possible to render the engagement between the plate springs 90 and the locking portions 91 more difficult to disengage.

Next, description will be given of the actions of the liquid ejecting apparatus 1, which is configured as described above.

The liquid ejecting apparatus 1 is provided with the main tank 21 which stores the liquid which is supplied to the liquid ejecting unit 11, and the liquid container 23 can be attached to and detached from the container storage portion 22 of the main tanks 21. The container storage portion 22 is provided with the liquid supply portion 32 which supplies the liquid to the liquid ejecting unit 11 side, and the dampers 58 and 59. In each of the dampers 58 and 59, the piston 102 is disposed so as to seal one end of the concave portion space 101*a* which is concave in the mounting direction B of the liquid container 23. Each of the dampers 58 and 59 is an air-damper which compresses the air of the concave portion space 101*a* and generates a buffering action by causing the piston 102 to move in the mounting direction B.

Meanwhile, the liquid container 23 is provided with the adapter 80 which is disposed on the side portion of the side of the direction of mounting to the container storage portion 22 (the mounting direction B side), and the liquid storage pouch 70 is aligned using the adapter 80. The liquid outlet portion 81 which is connected to the liquid supply portion 32 is formed on the adapter 80, and in addition, the first concave portion 88 and the second concave portion 89 which are concave in the opposite direction to the mounting direction B are formed on each side of the liquid outlet portion 81. The bottom surface 88*a* of the first concave portion 88 and the bottom surface 89*a* of the second concave portion 89 respectively face the dampers 58 and 59 in the mounting direction B. Therefore, when the liquid container 23 moves in the mounting direction B, the liquid container 23 abuts the pistons 102 of the dampers 58 and 59, causes the pistons 102 to move in the mounting direction B, and compresses the air of the concave portion spaces 101*a*.

In this manner, by disposing the dampers 58 and 59, in which the direction in which the buffering action is generated (the compression direction E) matches the mounting direction B of the liquid container 23, between the liquid container 23 and the container storage portion 22, it is possible to reduce the shock that arises when the liquid container 23 collides with the container storage portion 22 due to the buffering action of the dampers 58 and 59 when the liquid container 23 is mounted to the container storage portion 22.

It is possible to increase the length of the expansion and contraction stroke (the movement strokes of the pistons 102) of the dampers 58 and 59 by the depth of the concave portions due to the abutting portions with which the dampers 58 and 59 abut (the first concave portion 88 and the second concave portion 89) being concave portions. Therefore, it is possible to increase the buffering action, and it is possible to further reduce the shock which is applied to the liquid container 23 during mounting.

In the present embodiment, since the buffering action of the dampers 58 and 59 is generated before the liquid outlet portion 81 is connected to the liquid supply portion 32, the shock that is sustained by the liquid outlet portion 81 and the liquid supply portion 32 is reduced. The dampers 58 and 59 are disposed at equal distance from each other to interpose the liquid outlet portion 81. Therefore, the buffering action is generated in mirrored positions in relation to the liquid outlet portion 81 and liquid supply portion 32, and the liquid container 23 does not incline easily in relation to the container storage portion 22. Accordingly, it is possible to suppress the misalignment of the liquid outlet portion 81 and the liquid supply portion 32.

In the present embodiment, the liquid container 23 is placed on the tray 24 and is removed from and inserted into the container storage portion 22. In the front ends in the mounting direction B of the liquid container 23 and the tray 24, the first engagement portion 25 and the second engagement portion 26 which are provided in the tray 24 engage with the first engagement target portion 84 and the second engagement target portion 85 which are provided in the adapter 80 of the liquid container 23 in a direction (the container vertical direction Z) which orthogonally intersects the mounting direction B.

The two engagement portions engage at positions which overlap the straight line D which joins the centers of the dampers 58 and 59 when viewed from the mounting direction B (the +Y direction). Due to this disposition, when a repulsive force acts from the dampers 58 and 59 during the mounting of the liquid container 23, it is possible to suppress the misalignment of the liquid container 23 in an anti-mounting direction (the −Y direction) in relation to the tray 24 due to the repulsive force. Therefore, it is possible to suppress the assumption of a state in which the liquid outlet portion 81 and the liquid supply portion 32 are poorly connected to each other.

Note that, in the present embodiment, two sets of the air damper (the dampers 58 and 59) and the abutting portion (the bottom surface 88*a* of the first concave portion 88 and the bottom surface 89*a* of the second concave portion 89) are provided; however, three or more sets may be provided. Even when three or more sets are provided, it is preferable to dispose the sets divided over both sides of the liquid outlet portion 81. It is preferable to dispose the sets to be mirrored in the container width direction X, using the liquid outlet portion 81 as a reference.

Second Embodiment

Next, description will be given of the second embodiment of the liquid ejecting apparatus and the liquid supply apparatus, and the liquid supply system and the liquid supply method which supply the liquid to the same liquid ejecting apparatus, with reference to the drawings.

Hereinafter, in the description of the second embodiment, description of components which have the same reference numerals as those in the first embodiment will be omitted, and description will be given mainly of the points which differ from the first embodiment.

Figure 11:
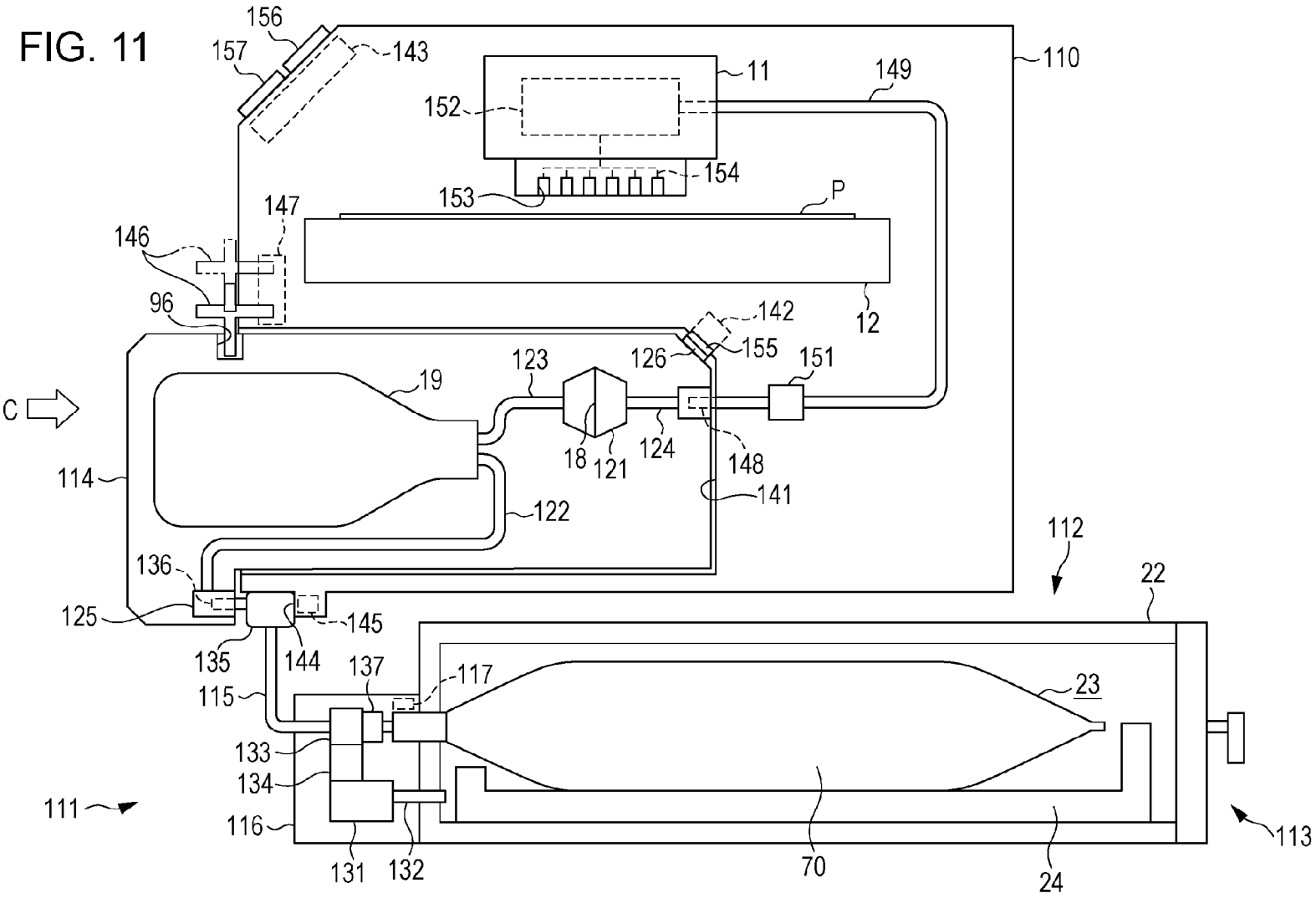
FIG. 11 is a diagram schematically illustrating a second embodiment of the liquid ejecting apparatus and the liquid supply apparatus in addition to a liquid supply system.

As illustrated in FIG. 11, the liquid is supplied to a liquid ejecting apparatus 110 of the present embodiment by a liquid supply system 111. The liquid supply system 111 is formed of a liquid supply apparatus 112 to which the liquid container 23 is mounted.

The liquid supply apparatus 112 is provided with a liquid storage body holding apparatus 113, a substitute mounting body 114, a relay flow path 115, and a pump mechanism 116. The relay flow path 115 communicates the liquid container 23 which is capable of storing the liquid with the substitute mounting body 114, and the pump mechanism 116 is for pumping the liquid which is stored in the liquid container 23 to the liquid ejecting apparatus 110.

The liquid storage body holding apparatus 113 is provided with the container storage portion 22 and the tray 24. The container storage portion 22 serves as the second liquid storage body mounting portion to and from which the liquid container 23 which serves as the second liquid storage body can be attached and detached, and the liquid container 23 is placed on the tray 24.

The substitute mounting body 114 is provided with a filter chamber 121, the storage container 19, a first supply path 122, a second supply path 123, and a third supply path 124.

The filter chamber 121 houses the filter 18, the downstream end of the first supply path 122 is inserted into the storage container 19, the downstream end of the second supply path 123 is inserted into the storage container 19 and the downstream end of the second supply path 123 communicates with the filter chamber 121, and the downstream end of the third supply path 124 communicates with the filter chamber 121.

The pump mechanism 116 is provided with a pressurization supply unit 131, a pressurization tube 132, an open-close valve 133, a control unit 134, and a remaining amount detection unit 137. The pressurization supply unit 131 pumps pressurized air, the pressurization tube 132 is for introducing the pressurized air which is pumped from the pressurization supply unit 131 into the container storage portion 22, the open-close valve 133 is capable of blocking the relay flow path 115, and the control unit 134 controls the pressurization supply unit 131 and the open-close valve 133. The pressurization supply unit 131 supplies the liquid which is stored in the liquid container 23 to the substitute mounting body 114 under pressure by pumping the pressurized air into the container storage portion 22 through the pressurization tube 132.

The remaining amount detection unit 137 is a sensor which detects that the remaining amount of the liquid which is stored in the liquid container 23 is less than a predetermined value. For example, the remaining amount detection unit 137 is provided with an elastic body capable of elastically deforming which is disposed in the relay flow path 115, and a lever, the position of which changes with the deformation of the elastic body. The remaining amount detection unit 137 detects a change in the lever position which is caused by the elastic body, which had been compressively deformed by the pressure of the liquid in the relay flow path 115, deforming restoratively with the reduction in the pressure of the liquid.

Therefore, when the liquid which is stored in the liquid container 23 is depleted and the liquid does not flow out to the relay flow path 115 even using the pressurization, since the pressure in the relay flow path 115 is reduced and the position of the lever changes, it is possible to detect that the remaining amount of the liquid is less than the predetermined value. When the amount of the liquid which is stored in the liquid container 23 is greater than or equal to the predetermined value, it is possible to confirm whether the liquid in the liquid container 23 is in a sufficiently pressurized state by detecting the change in the lever position due to the pressurization using the remaining amount detection unit 137.

A first connection portion 135 which has a connection needle 136 is provided on the downstream end of the relay flow path 115. A second connection portion 125 is provided on the upstream end of the first supply path 122 of the substitute mounting body 114 and is capable of connecting to and detaching from the connection needle 136 of the first connection portion 135.

The pump mechanism 116 is provided with a mounting detection unit 117 which is capable of detecting whether or not the liquid container 23 is mounted to the container storage portion 22. In the present embodiment, the mounting detection unit 117 detects that the liquid container 23 is mounted to the container storage portion 22 due to the connection terminal 62 (refer to FIG. 9B) which is provided in the container storage portion 22 being electrically connected to the terminal portion of the circuit board 83 (refer to FIG. 9B) which is provided in the liquid container 23.

The liquid ejecting apparatus 110 of the present embodiment is provided with a common mounting portion 141 and a mounting target detection unit 142. A first liquid storage body 95 (refer to FIG. 12) which is capable of storing the liquid and the substitute mounting body 114 can be exchangeably mounted to the common mounting portion 141, and the mounting target detection unit 142 is capable of detecting whether or not the first liquid storage body 95 and the substitute mounting body 114 are mounted to the common mounting portion 141. The first liquid storage body 95 is, for example, an ink cartridge which stores an ink.

The liquid ejecting apparatus 110 is provided with a main control unit 143, an operation unit 156, and a display unit 157. The main control unit 143 performs the control of the liquid ejecting unit 11 and the like, the operation unit 156 is for inputting instructions to the main control unit 143 or the like, and the display unit 157 displays the control status or the like according to the main control unit 143.

In the present embodiment, a circuit board 126 which has a terminal portion on the distal end portion is attached to the substitute mounting body 114 in the insertion direction C (the direction illustrated by the white-filled arrow in FIG. 11) in relation to the common mounting portion 141. A connection terminal 155 which is capable of electrically connecting to the terminal portion of the circuit board 83 is provided on the inner side of the common mounting portion 141. The mounting target detection unit 142 detects that the substitute mounting body 114 is mounted to the common mounting portion 141 due to the terminal portion of the circuit board 126 which is attached to the substitute mounting body 114 electrically connecting to the connection terminal 155 with the insertion of the substitute mounting body 114 into the common mounting portion 141.

Figure 12:
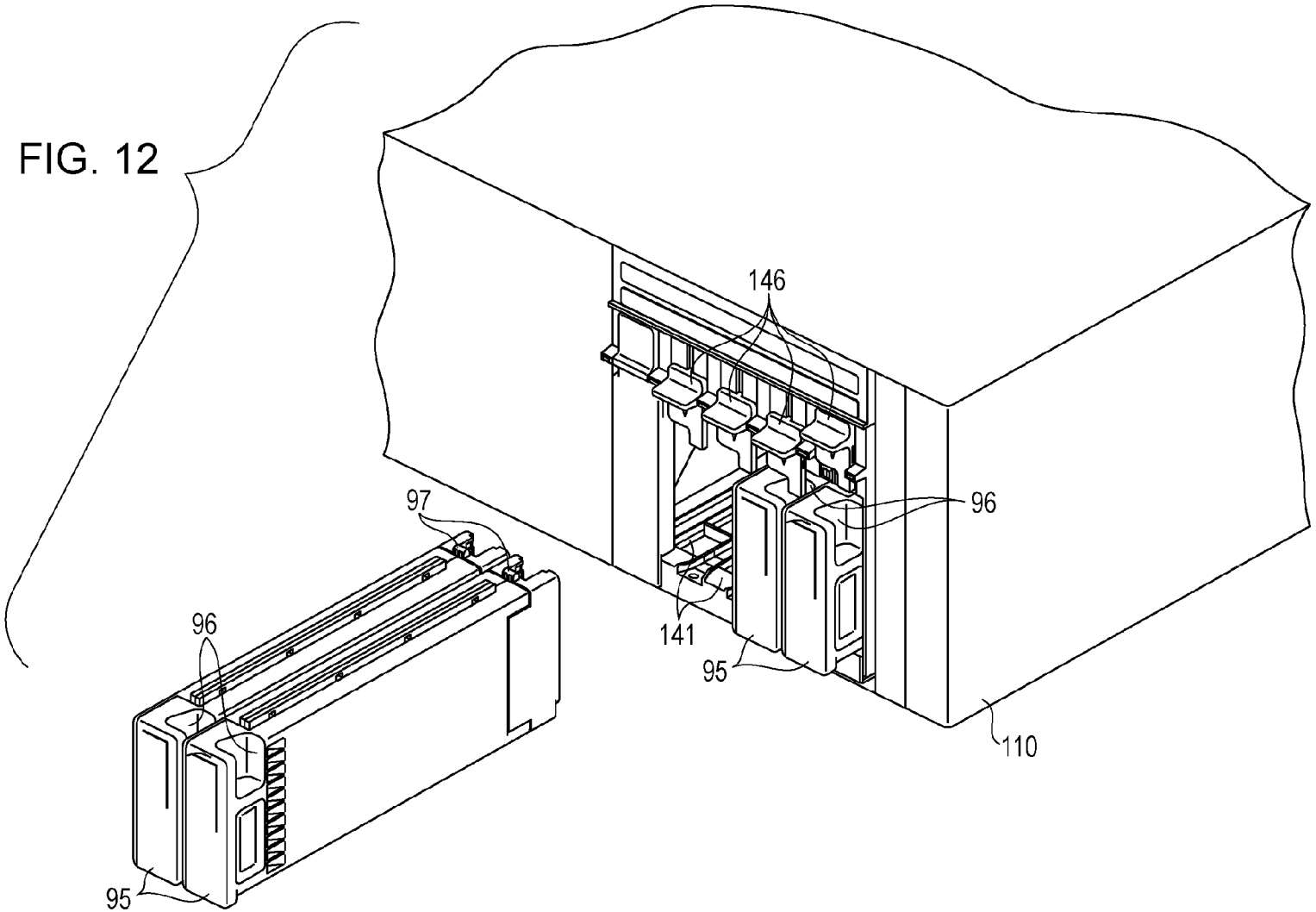
FIG. 12 is a perspective view of common mounting portions and first liquid storage bodies which are provided in the liquid ejecting apparatus of FIG. 11.

As illustrated in FIG. 12, a circuit board 97 is attached to the first liquid storage body 95. The circuit board 97 has a terminal portion on the distal end portion thereof in the insertion direction C in relation to the common mounting portion 141. The mounting target detection unit 142 detects that the first liquid storage body 95 is mounted to the common mounting portion 141 due to the terminal portion of the circuit board 97 which is attached to the first liquid storage body 95 electrically connecting to the connection terminal 155 with the insertion of the first liquid storage body 95 into the common mounting portion 141.

As illustrated in FIG. 11, the common mounting portion 141 is provided with an attachment portion 144 and an attachment detection unit 145. The first connection portion 135 is attached to the attachment portion 144 in a removable state, and the attachment detection unit 145 is capable of detecting whether or not the first connection portion 135 is in a state of being attached to the attachment portion 144. When the first connection portion 135 is appropriately attached to the attachment portion 144, the connection needle 136 protrudes from the common mounting portion 141 in the opposite direction from the insertion direction C.

Note that, in the substitute mounting body 114, when a configuration is adopted in which the portion at which the second connection portion 125 is provided protrudes further than the outer shape of the first liquid storage body 95, even if the state in which the first connection portion 135 is attached to the attachment portion 144 is maintained, it is possible to mount the first liquid storage body 95 to the common mounting portion 141.

In the state in which the first connection portion 135 is attached to the attachment portion 144, the substitute mounting body 114 is connected to the relay flow path 115 in the process of the substitute mounting body 114 being mounted to the mounting portion 13 by the first connection portion 135 being connected to the second connection portion 125.

The common mounting portion 141 is provided with a restriction portion 146 which is capable of restricting the detachment of the substitute mounting body 114 and the first liquid storage body 95 which are mounted to the common mounting portion 141. The restriction portion 146 is capable of moving between a restriction position illustrated by the solid line in FIG. 11, and a restriction released position illustrated by the double-dot-dash line in FIG. 11. The restriction position is a position which restricts the detachment (the pulling out) of the first liquid storage body 95 and the substitute mounting body 114 which are mounted to the common mounting portion 141, and the restriction released position is a position which allows the attachment and detachment of the first liquid storage body 95 and the substitute mounting body 114 which are mounted in the common mounting portion 141. The common mounting portion 141 is provided with a restriction detection unit 147 which is capable of detection whether or not the restriction portion 146 is in the restriction position.

As illustrated in FIG. 12, it is possible to use a locking lever for the restriction portion 146, for example, and in this case, it is preferable to provide the first liquid storage body 95 and the substitute mounting body 114 with an engagement concave portion 96 capable of inserting or extracting the restriction portion 146 which is a locking lever in the proximity of the opening portion of the common mounting portion 141 in a state of being mounted to the common mounting portion 141. It is preferable for the liquid ejecting apparatus 110 to be provided with a plurality (in the present embodiment, four) of the common mounting portions 141.

As illustrated in FIG. 11, the liquid ejecting apparatus 110 of the present embodiment is provided with a supply flow path 149, a pressurization unit 151, and a pressure adjustment mechanism 152. A supply needle 148 is provided on the downstream end of the supply flow path 149, the liquid ejecting unit 11 is connected to the upstream end of the supply flow path 149, the pressurization unit 151 is provided part way down the supply flow path 149, and the downstream end of the supply flow path 149 communicates with the pressure adjustment mechanism 152. The liquid ejecting unit 11 is provided with a plurality of nozzles 153 which eject the liquid, and liquid supply paths 154 which communicate the pressure adjustment mechanism 152 with the nozzles 153.

When the liquid is ejected from the nozzles 153 or the like and the pressure of the liquid supply path 154 assumes a lower negative pressure than a threshold Pm ($Pm<0$) which is set in advance, the pressure adjustment mechanism 152 communicates the supply flow path 149 with the liquid supply path 154, and when the pressure of the liquid supply path 154 is greater than or equal to the threshold Pm, the pressure adjustment mechanism 152 restricts the communication between the supply flow path 149 and the liquid supply path 154. Therefore, even if the pressure in the supply flow path 149 assumes a pressurized state due to the driving of the pressurization unit 151, the liquid is not supplied to the nozzles 153 due to the pressure adjustment mechanism 152 restricting the communication between the supply flow path 149 and the liquid supply path 154.

Note that, a configuration may be adopted in which the liquid which is supplied to the liquid ejecting unit 11 through the supply flow path 149 is returned to the storage container 19 through a cyclic flow path (not shown). The upstream end of the cyclic flow path is connected to the liquid ejecting unit 11, and the downstream end of the cyclic flow path is inserted into the storage container 19. In this case, since it is possible to cause the liquid to cycle between the storage container 19 and the liquid ejecting unit 11 through the cyclic flow path and the supply flow path 149, it becomes possible to suppress the precipitation of a precipitate component, even when the liquid contains a precipitate component such as pigment, for example.

Here, it is preferable that, when the substitute mounting body 114 is mounted to the common mounting portion 141, the inside of the storage container 19 is filled with the liquid and the substitute mounting body 114 is subsequently mounted to the common mounting portion 141. If such a configuration is adopted, it is possible to suppress the entrance of bubbles into the supply flow path 149 when connecting the third supply path 124 to the supply flow path 149.

It is preferable to allow the liquid which is stored in the liquid container 23 to the relay flow path 115 using the drive of the pressurization supply unit 131 and render the connection needle 136 filled with the liquid to the distal end before attaching the first connection portion 135 to the attachment portion 144. If such a configuration is adopted, it is possible to suppress the entrance of bubbles into the first supply path 122 when connecting the relay flow path 115 to the first supply path 122 with the mounting of the substitute mounting body 114 to the common mounting portion 141.

It is preferable that, when starting the supply of the liquid from the liquid container 23, the relay flow path 115 which is filled with the liquid is connected to the first supply path 122 and the storage container 19 which is filled with the liquid is connected to the supply flow path 149, and subsequently, the supply flow path 149, the pressure adjustment mechanism 152, the liquid supply path 154, and the nozzles 153 are filled with the liquid by discharging the liquid from the nozzles 153. If such a configuration is adopted, it is possible to discharge the bubbles from inside the flow path in one filling operation, even if the bubbles enter the flow path with the connection of the substitute mounting body 114 or the relay flow path 115.

Next, description will be given of the electrical configuration of the liquid supply system 111.

Figure 13:
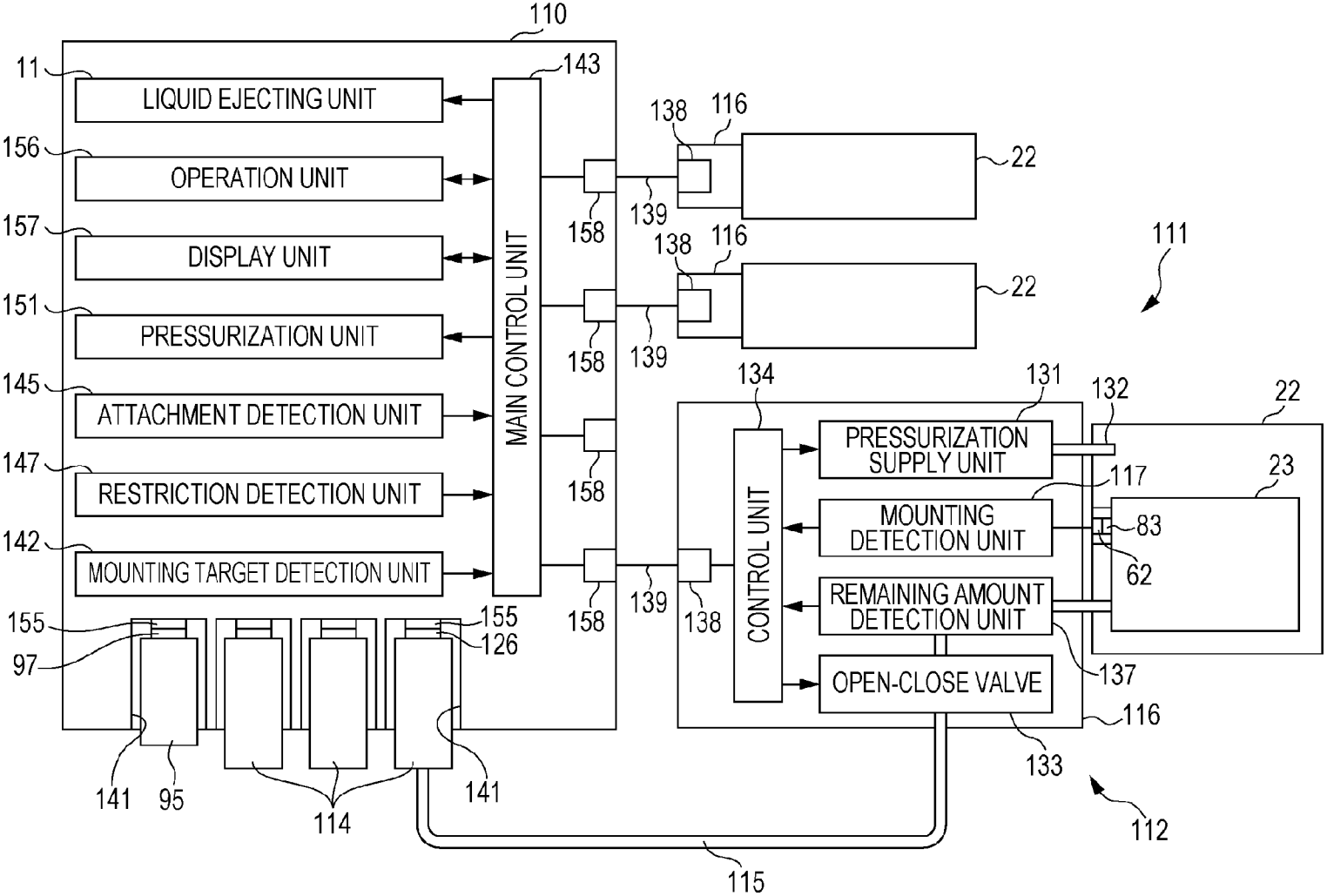
FIG. 13 is a block diagram illustrating the electrical configuration of the liquid supply system.

As illustrated in FIG. 13, the liquid ejecting apparatus 110 is provided with a plurality of (in the present embodiment, four) connectors 158 which correspond to the number of the common mounting portions 141. The connector 158 is for electrically connecting the pump mechanism 116 to the liquid ejecting apparatus 110, such as a USB connector, for example.

A cable 139 such as a USB cable which is connected to the connector 138 which provided in the pump mechanism 116 is connected to the connector 158. The main control unit 143 of the liquid ejecting apparatus 110 is connected to the control unit 134 of the pump mechanism 116 in a state of being capable of communication via the connectors 138, 158, and the cable 139.

Note that, although it is also possible to supply power from the liquid ejecting apparatus 110 through the cable 139, it is preferable to provide the pump mechanism 116 with a power plug and to drive the pump mechanism 116 using the power which is supplied through the power plug.

The main control unit 143 of the liquid ejecting apparatus 110 is electrically connected to the liquid ejecting unit 11, the operation unit 156, the display unit 157, the pressurization unit 151, the mounting target detection unit 142, the attachment detection unit 145, and the restriction detection unit 147. The main control unit 143 transmits the detection results of the mounting target detection unit 142, the attachment detection unit 145, and the restriction detection unit 147 to the control unit 134.

The control unit 134 of the pump mechanism 116 is electrically connected to the pressurization supply unit 131, the open-close valve 133, the mounting detection unit 117, and the remaining amount detection unit 137. The control unit 134 transmits the detection results of the mounting detection unit 117 and the remaining amount detection unit 137 to the main control unit 143. The control unit 134 controls the pressurization supply unit 131 and the open-close valve 133 based on the detection results of the mounting target detection unit 142, the attachment detection unit 145, the restriction detection unit 147, the mounting detection unit 117, and the remaining amount detection unit 137.

Next, description will be given of the liquid supply method which is used by the liquid supply apparatus 112 of the present embodiment.

When all of a plurality (in the present embodiment, the five control conditions (1) to (5) indicated below) of control conditions are satisfied, the control unit 134 starts the driving of the pressurization supply unit 131, the control unit 134 causes the pressurization supply unit 131 to start being driven, assuming that the open-close valve 133 is in the closed-valve state in the pump mechanism 116 in which the mounting of the substitute mounting body 114 is detected in the control condition (2) below.

(1) The liquid which is stored in the liquid container 23 is in a pressurizable state.

(2) The mounting target detection unit 142 detects the mounting of the substitute mounting body 114 to the common mounting portion 141.

(3) The attachment detection unit 145 detects the attachment of the first connection portion 135 to the attachment portion 144.

(4) The restriction detection unit 147 detects that the restriction portion 146 is in the restriction position.

(5) The mounting target detection unit 142 detects the mounting of the first liquid storage body 95 or the substitute mounting body 114 in relation to all of the common mounting portions 141.

Note that, in the present embodiment, when the mounting detection unit 117 detects the mounting of the liquid container 23 to the container storage portion 22, the control unit 134 determines that the liquid which is stored in the liquid container 23 is in a pressurizable state in the control condition (1).

In other words, in the liquid supply apparatus 112, when the liquid which is stored in the liquid container 23 assumes a pressurizable state due to the mounting of the liquid container 23 to the container storage portion 22, and the supply of the liquid to the liquid ejecting apparatus 110 becomes possible due to the mounting of the substitute mounting body 114 to the common mounting portion 141, the pressurization supply unit 131 starts the driving.

When the pressurized air is pumped to the container storage portion 22 by the driving of the pressurization supply unit 131, the pressure within the container storage portion 22 rises, the liquid storage pouch 70 of the liquid container 23 is crushed by the air pressure, and the liquid of the inner portion of the liquid storage pouch 70 is pressurized.

Therefore, the pressurized liquid flows out from the liquid container 23 to the relay flow path 115, and the pressure of the liquid in the relay flow path 115 rises.

When the pressure of the liquid inside the relay flow path 115 rises, since the elastic body which is disposed in the relay flow path 115 compressively deforms, it is confirmed that the liquid inside the liquid container 23 is in the pressurized state based on the detection results of the remaining amount detection unit 137. Note that, causing the liquid within the liquid container 23 to rise to a pressure at which it is possible to perform pressurized supply of the liquid by driving the pressurization supply unit 131 is referred to as preliminary pressurization.

When the preliminary pressurization ends, the control unit 134 transmits a signal indicating that the preliminary pressurization has ended to the main control unit 143 of the liquid ejecting apparatus 110. The main control unit 143 of the liquid ejecting apparatus 110 which receives the signal controls the pressurization unit 151 to start the supply of the liquid to the liquid ejecting unit 11, and controls the liquid ejecting unit 11 to perform the printing onto the medium P. Meanwhile, the control unit 134 supplies the liquid which is stored in the liquid container 23 to the substitute mounting body 114 under pressure, assuming that the open-close valve 133 is in the open-valve state.

Accordingly, the liquid which is stored in the liquid container 23 is introduced into the storage container 19 by the pressurization force of the pressurization supply unit 131, and the liquid in the storage container 19 is supplied to the liquid ejecting unit 11 by the pressurization force of the pressurization unit 151. At this time, even if the drive timing of the pressurization supply unit 131 is shifted from the drive timing of the pressurization unit 151, the variation in the pressure of the supply flow path 149 which communicates with the liquid ejecting unit 11 is suppressed due to the storage container 19 flexibly deforming. Unnecessary variations in the pressure of the liquid supply path 154 which communicates with the nozzles 153 are suppressed by the effect of the pressure adjustment mechanism 152 which is connected to the supply flow path 149. Therefore, it is possible to perform the operation of ejecting the liquid from the liquid ejecting unit 11 in a stable manner.

Next, description will be given of the operations of the liquid ejecting apparatus 110, the liquid supply apparatus 112, the liquid supply method carried out by the liquid supply apparatus 112, and the liquid supply system 111, which are configured as described above.

In the present embodiment, the liquid container 23 is connected to the liquid ejecting apparatus 110 after undergoing the following procedures (1) to (4).

(1) Mount the liquid container 23 to the container storage portion 22.

(2) Attach the first connection portion 135 to the attachment portion 144.

(3) Mount the substitute mounting body 114 to the common mounting portion 141.

(4) Restrict the detachment of the substitute mounting body 114 using the restriction portion 146.

When the procedure (1) is carried out, since the mounting detection unit 117 detects the mounting of the liquid container 23 to the container storage portion 22, the control condition (1) is satisfied.

Next, when the procedure (2) is carried out, since the attachment detection unit 145 detects the attachment of the first connection portion 135 to the attachment portion 144, the control condition (3) is satisfied.

When the procedure (3) is carried out, since the mounting target detection unit 142 detects the mounting of the substitute mounting body 114 to the common mounting portion 141, the control condition (2) is satisfied.

Subsequently, when the procedure (4) is carried out, since the restriction detection unit 147 detects that the restriction portion 146 is in the restriction position, the control condition (4) is satisfied.

The control condition (5) is satisfied due to all of the mounting target detection units 142 detecting the mounting of the first liquid storage body 95 or the substitute mounting body 114 to the corresponding common mounting portions 141. When the control conditions (1) to (5) are satisfied in this manner, the preliminary pressurization is started by the pressurization supply unit 131.

In addition, when the procedure (3) is carried out, since the first connection portion 135 is connected to the second connection portion 125 and the supply needle 148 is connected to the third supply path 124, the liquid container 23 assumes a state of being capable of communicating with the liquid ejecting unit 11 through the relay flow path 115, the storage container 19, the first supply path 122, the second supply path 123, the third supply path 124, and the supply flow path 149.

In other words, when the preliminary pressurization is started by the pressurization supply unit 131, since the liquid container 23 is in a state of being capable of communicating with the liquid ejecting unit 11, after the preliminary pressurization is completed, it is possible to quickly start the pressurized supply of the liquid to the liquid ejecting unit 11 by opening the open-close valve 133.

Therefore, the occurrence of a situation in which the preliminary pressurization is performed despite the liquid container 23 not being in a state of being capable of communicating with the liquid ejecting unit 11 due to the liquid container 23 not being mounted to the container storage portion 22, the first connection portion 135 not being connected to the second connection portion 125, or the like, resulting in the driving of the pressurization supply unit 131 being performed wastefully is suppressed.

Note that, when any of the control conditions (1) to (4) is not satisfied, it is preferable for the control unit 134 to quickly or, after a predetermined time has elapsed, stop the driving of the pressurization supply unit 131. If such a configuration is adopted, when the liquid container 23 enters a state of being unable to communicate with the liquid ejecting unit 11 due to the liquid container 23 being detached from the container storage portion 22, the substitute mounting body 114 being detached from the common mounting portion 141, or the like, since the driving of the pressurization supply unit 131 is stopped, it is possible to suppress the wasteful driving of the pressurization supply unit 131.

Additionally, it is preferable to provide a sensor which detects the opening and closing of the opening and closing door 43 (refer to FIG. 2) of the blown tank 40 (refer to FIG. 2), and that even when the sensor detects that the opening and closing door 43 is open, the driving of the pressurization supply unit 131 is stopped.

In this case, even if the control condition (4) is not satisfied, since the substitute mounting body 114 is not necessarily detached from the common mounting portion 141 straight away, the time until the driving of the pressurization supply unit 131 is stopped may be long. Since the substitute mounting body 114 is provided with the storage container 19, even if the liquid container 23 is detached from the container storage portion 22, it is possible to continue supplying the liquid to the liquid ejecting unit 11 while the liquid which is stored in the storage container 19 remains.

Even if a predetermined time elapses from the start of the driving of the pressurization supply unit 131, it is preferable to stop the driving of the pressurization supply unit 131, even when the remaining amount detection unit 137 does not confirm that the liquid within the liquid container 23 is in a pressurized state. In this case, since causes such as operational faults of the pressurization supply unit 131, mounting faults of the liquid container 23, or the liquid within the liquid container 23 being depleted by the leaking out of the liquid from the liquid container 23 are conceivable, it is preferable to notify the user of the fact using a buzzer, an error display, or the like.

In this manner, even if the liquid container 23 is detached, since it is possible to continue supplying the liquid to the liquid ejecting unit 11 while the liquid which is stored within the storage container 19 remains, when the remaining amount detection unit 137 detects that the remaining amount of the liquid which is stored in the liquid container 23 is less than a predetermined value, the exchanging of the liquid container 23 may be performed while continuing the printing.

According to the embodiments described above, it is possible to obtain the following effects.

(1) When the liquid which is stored in the liquid container 23 enters a pressurizable state and the mounting target detection unit 142 detects the mounting of the substitute mounting body 114 to the common mounting portion 141, since the pressurization supply unit 131 is driven, it is possible to appropriately supply the liquid which is stored in the liquid container 23 through the relay flow path 115 due to the pressurization supply unit 131 being driven. Meanwhile, when the liquid which is stored in the liquid container 23 is not in the pressurizable state, or when the substitute mounting body 114 is not mounted to the common mounting portion 141, since the pressurization supply unit 131 is not driven, the wasteful driving of the pressurization supply unit 131 does not occur. Therefore, it is possible to appropriately supply the liquid according to the mounting state of the liquid storage body.

(2) When the liquid container 23 is mounted to the container storage portion 22, since the liquid which is stored in the liquid container 23 is determined to be in the pressurizable state, it is possible to appropriately supply the liquid according to the mounting state of the liquid container 23 to the container storage portion 22. Meanwhile, when the liquid container 23 is not mounted to the container storage portion 22, since the pressurization supply unit 131 is not driven, the wasteful driving of the pressurization supply unit 131 does not occur.

(3) Since the driving of the pressurization supply unit 131 is started after the attachment detection unit 145 detects the fact that the first connection portion 135 which is provided on the downstream end of the relay flow path 115 is attached to the attachment portion 144 of the common mounting portion 141, when the liquid is supplied, it is possible to reliably hold the relay flow path 115 in the common mounting portion 141.

(4) The first connection portion 135 is connected to the second connection portion 125 in a state in which the first connection portion 135 is attached to the attachment portion 144 through the process of the substitute mounting body 114 being mounted to the common mounting portion 141. Therefore, it is possible to confirm the connection between the substitute mounting body 114 and the relay flow path 115 due to the mounting target detection unit 142 detecting the mounting of the substitute mounting body 114 to the common mounting portion 141. In addition to this detection, the fact that the common mounting portion 141, the substitute mounting body 114, and the relay flow path 115 are connected to each other is confirmed by detecting the attachment of the first connection portion 135 to the attachment portion 144. Therefore, it is possible to appropriately supply the liquid which is stored in the liquid container 23 to the common mounting portion 141 due to the pressurization supply unit 131 being driven after the confirmation.

(5) When the restriction detection unit 147 detects that the restriction portion 146 is in the restriction position, since it is conceivable that the substitute mounting body 114 which is mounted to the common mounting portion 141 is restricted from being detached, it is possible to appropriately supply the liquid in a state in which the substitute mounting body 114 is reliably mounted to the common mounting portion 141.

(6) Since the driving of the pressurization supply unit 131 is started when one or more of the first liquid storage bodies 95 or the substitute mounting bodies 114 are mounted to a plurality of the common mounting portions 141, it is possible to appropriately supply the liquid of the first liquid storage bodies 95 or the liquid containers 23 which are mounted to the plurality of common mounting portions 141.

Note that, the second embodiment may be modified as in the modification examples indicated below.

A configuration may be adopted in which the liquid ejecting apparatus 110 is provided with the pressurization supply unit 131, and the pressurization supply unit 131 is driven by the control of the main control unit 143 of the liquid ejecting apparatus 110.

The first connection portion 135 may be attached to the attachment portion 144 in a non-removable state. In this case, a configuration may be adopted in which the attachment detection unit 145 and the control condition (3) are not provided.

The first connection portion 135 may be directly connected to the substitute mounting body 114 without the attachment portion 144 being provided on the liquid ejecting apparatus 110. In this case, a configuration may be adopted in which the attachment detection unit 145 and the control condition (3) are not provided.

It is possible to arbitrarily change the number of the common mounting portions 141 to be provided in the liquid ejecting apparatus 110. For example, a configuration may be adopted in which the liquid ejecting apparatus 110 is provided with one or a plurality of the first liquid storage body mounting portions, to which only the first liquid storage body 95 is mounted, and one or a plurality of the common mounting portions 141. A configuration may be adopted in which, when only one of the common mounting portions 141 is provided in the liquid ejecting apparatus 110, it is not necessary to include the control condition (5) in the control conditions for starting the driving of the pressurization supply unit 131.

The restriction portion 146 may be a cap member which covers the opening of the common mounting portion 141.

A configuration may be adopted in which the restriction portion 146, the restriction detection unit 147, and the control condition (4) are not provided. Even in this case, it is possible to detect the mounting of the substitute mounting body 114 to the common mounting portion 141 using the mounting target detection unit 142. However, if the restriction portion 146 is provided in the proximity of the common mounting portion 141, it is possible to reliably insert the substitute mounting body 114 and the first liquid storage body 95 into the inside of the common mounting portion 141 and to subsequently detect the mounting of the substitute mounting body 114 and the first liquid storage body 95.

The pressurization supply unit 131 which supplies the liquid which is stored in the liquid container 23 under pressure is not limited to pumping pressurized air. For example, the pressurization supply unit 131 may supply the liquid under pressure using the variation in a differential head caused by raising the liquid container 23, and alternatively, the pressurization supply unit 131 may supply the liquid under pressure by sucking the inside of the liquid container 23, or crushing the liquid container 23 using a spring or the like.

A configuration may be adopted in which protrusions of different shapes or the like are provided on the substitute mounting body 114 and the first liquid storage body 95, and the mounting target detection unit 142 detects whether or not the substitute mounting body 114 and the first liquid storage body 95 are mounted by mechanically detecting the protrusions which differ in shape in this manner.

A configuration may be adopted in which the remaining amount detection unit 137 is disposed closer to the substitute mounting body 114 side (the downstream side) than the open-close valve 133, and is not disposed closer to the liquid container 23 side (the upstream side) than the open-close valve 133, as illustrated in FIG. 11.

The liquid ejecting apparatus may be changed to a so-called full line type of liquid ejecting apparatus which is provided with the liquid ejecting unit 11 which is fixed and is a long shape corresponding to the total width of the medium P. In this case, the print range of the liquid ejecting unit 11 may be rendered to span the entire width of the medium P by disposing, in parallel, a plurality of unit heads in which the nozzles are formed.

Alternatively, the print range of the liquid ejecting unit 11 may be rendered to span the entire width of the medium P by disposing multiple nozzles in a single long head so as to span the entire width of the medium P.

The liquid that is ejected by the liquid ejecting unit 11 is not limited to an ink, and may be, for example, a liquid-state body in which particles of a functional material are dispersed or mixed into a liquid. For example, a configuration may be adopted in which the liquid ejecting apparatus ejects a liquid-state body which contains a material such as an electrode material or a color material (pixel material) in the form of a dispersion or a solution. The electrode material or the color material may be used in the manufacture or the like of liquid crystal displays, Electro-Luminescence (EL) displays, and surface emission displays.

The medium P is not limited to paper, and may be plastic film, thin plate material, or the like, and may also be a fabric used in a textile printing apparatus or the like.

The entire disclosure of Japanese Patent Application No. 2014-157603, filed Aug. 1, 2014 is expressly incorporated by reference herein.

What is claimed is:

1. A liquid supply system, comprising:

a common mounting portion into which a first liquid storage body capable of storing a liquid and a substitute mounting body which is connected to a second liquid storage body capable of storing a liquid via a relay flow path can be exchangeably mounted;

a mounting target detection unit capable of detecting whether or not the first liquid storage body and the substitute mounting body are mounted to the common mounting portion;

a pressurization supply unit which supplies the liquid which is stored in the second liquid storage body to the substitute mounting body under pressure;

a second liquid storage body mounting portion to and from which the second liquid storage body can be attached and detached;

a mounting detection unit capable of detecting whether or not the second liquid storage body is mounted to the second liquid storage body mounting portion; and a control unit which drives the pressure supply unit when a plurality of control conditions are satisfied, wherein the control conditions include the liquid which is stored in the second liquid storage body entering a pressurizable state and the mounting target detection unit detecting mounting of the substitute mounting body to the common mounting portion, wherein when the mounting detection unit detects that the second liquid storage body is mounted to the second liquid storage body mounting portion, the control unit determines that the liquid which is stored in the second liquid storage body is in the pressurizable state.

2. The liquid supply system according to claim 1, wherein the substitute mounting body is detachably connected to the relay flow path via a first connection portion which is provided on a downstream end of the relay flow path and a second connection portion which is provided on the substitute mounting body, wherein the common mounting portion includes an attachment portion to which the first connection portion is attached in a removable state, and an attachment detection unit capable of detecting whether or not the first connection portion is in a state of being attached to the attachment portion, and wherein the control conditions include the attachment detection unit detecting the first attachment unit being attached to the attachment portion.

3. The liquid supply system according to claim 2, wherein in a state in which the first connection portion is attached to the attachment portion, the first connection portion is connected to the second connection portion in a process of the substitute mounting body being mounted to the common mounting portion.

4. The liquid supply system according to claim 1, further comprising:

a restriction portion which is capable of restricting the substitute mounting body which is mounted to the common mounting portion from being detached and is capable of moving between a restriction position which restricts the substitute mounting body which is mounted to the common mounting portion from being detached and a restriction released position which allows the substitute mounting body which is mounted to the common mounting portion to be detached; and a restriction detection unit capable of detecting whether or not the restriction portion is in the restriction position, wherein the control conditions include the restriction detection unit detecting that the restriction portion is in the restriction position.

5. The liquid supply system according to claim 1, further comprising:

a plurality of the common mounting portions, wherein the control conditions include the mounting target detection unit detecting that the first liquid storage body or the substitute mounting body is mounted to the common mounting portion.

6. A liquid ejecting apparatus, comprising:

a liquid ejecting unit capable of ejecting a liquid;

a common mounting portion into which a first liquid storage body capable of storing a liquid and a substitute mounting body which is connected to a second liquid storage body capable of storing a liquid via a relay flow path can be exchangeably mounted;

a mounting target detection unit capable of detecting whether or not the first liquid storage body and the substitute mounting body are mounted to the common mounting portion;

a pressurization supply unit which supplies the liquid which is stored in the second liquid storage body to the substitute mounting body under pressure;

a second liquid storage body mounting portion to and from which the second liquid storage body can be attached and detached;

a mounting detection unit capable of detecting whether or not the second liquid storage body is mounted to the second liquid storage body mounting portion; and a control unit which drives the pressure supply unit when a plurality of control conditions are satisfied, wherein the control conditions include the liquid which is stored in the second liquid storage body entering a pressurizable state and the mounting target detection unit detecting mounting of the substitute mounting body to the common mounting portion, wherein when the mounting detection unit detects that the second liquid storage body is mounted to the second liquid storage body mounting portion, the control unit determines that the liquid which is stored in the second liquid storage body is in the pressurizable state.

7. A liquid supply method which is carried out by a liquid supply apparatus which includes a substitute mounting body which can be mounted, so as to be exchangeable with a first liquid storage body, to a common mounting portion to and from which the first liquid storage body capable of storing a liquid can be attached and detached;

a relay flow path which communicates a second liquid storage body capable of storing a liquid with the substitute mounting body;

a second liquid storage body mounting portion to and from which the second liquid storage body can be attached and detached;

a mounting detection unit capable of detecting whether or not the second liquid storage body is mounted to the second liquid storage body mounting portion; and a pressurization supply unit which supplies the liquid which is stored in the second liquid storage body to the substitute mounting body through the relay flow path under pressure, the method comprising:

causing the pressurization supply unit to start being driven when the liquid which is stored in the second liquid storage body enters a pressurizable state and the substitute mounting body is mounted to the common mounting portion; and determining that the liquid which is stored in the second liquid storage body is in the pressurizable state when the mounting detection unit detects that the second liquid storage body is mounted to the second liquid storage body mounting portion.

* * * * *